US006309272B1

(12) United States Patent
Nishimura

(10) Patent No.: US 6,309,272 B1
(45) Date of Patent: Oct. 30, 2001

(54) METHOD OF MAKING AN IMAGE FORMING APPARATUS

(75) Inventor: Michiyo Nishimura, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/213,859

(22) Filed: Dec. 17, 1998

(30) Foreign Application Priority Data

Dec. 26, 1997 (JP) ..... 9-360814

(51) Int. Cl.[7] ..... H01J 9/25
(52) U.S. Cl. ..... 445/25; 445/44
(58) Field of Search ..... 445/24, 25, 44

(56) References Cited

U.S. PATENT DOCUMENTS

| | | | | |
|---|---|---|---|---|
| 4,427,479 | * | 1/1984 | Glaser et al. | 445/25 |
| 5,066,883 | | 11/1991 | Yoshioka et al. | 313/309 |
| 5,505,647 | * | 4/1996 | Sato et al. | 445/25 |
| 5,769,678 | * | 6/1998 | Mohacsi | 445/25 |
| 5,820,435 | * | 10/1998 | Cooper et al. | 445/25 |

FOREIGN PATENT DOCUMENTS

| | | |
|---|---|---|
| 686990 | 12/1995 | (EP) . |
| 64-31332 | 2/1989 | (JP) . |
| 1-257552 | 10/1989 | (JP) . |
| 1-283749 | 11/1989 | (JP) . |
| 8-138554 | 5/1996 | (JP) . |

OTHER PUBLICATIONS

W. P. Dyke and W. W. Dolan, "Field Emission," Advances in Electronics and Electron Physics, 89–185 (1956).

C. A. Spindt et al., "Physical Properties of Thin–Film Field Emission Cathodes with Molybdenum Cones," J. Appl. Phys., V. 47, 5248–5263 (Dec. 1976).

C. A. Mead, "Operation of Tunnel–Emission Devices," J. Appl. Phys., V. 32, 646–652 (Apr. 1961).

M. I. Elinson et al., "The Emission of Hot Electrons and the Field Emission of Electrons from Tin Oxide," Radio Eng. & Electronic Phys., 1290–1296 (Jul. 1965).

G. Dittmer, "Electrical Conduction and Electron Emission of Discontinuous Thin Film," Thin Solid Films, 9, 317–328 (1972).

M. Hartwell and C. G. Fonstad, "Strong Electron Emission from Patterned Tin–Indium Oxide Thin Films," IEEE Trans. ED Conf. (IEDM), 519–521 (1975).

Hisashi Araki et al., "Electroforming and Electron Emission of Carbon Thin Films," Shinku (Vacuum), vol. 26, No. 1, pp. 22–29 (1983).

European Search Report Ref. No. HJF 2623230, dated May 4, 1999.

* cited by examiner

*Primary Examiner*—Kenneth J. Ramsey
(74) *Attorney, Agent, or Firm*—Fitzpatrick, Cella, Harper & Scinto

(57) ABSTRACT

A method for making an image forming apparatus includes an assembly of a first unit provided with an image-forming element and a second unit provided with electron emission devices. A bonding agent is provided at a bonding section of the first unit; the bonding agent is heated, and then the first unit and the second unit are bonded to each other. Alternatively, a bonding agent may be provided at a bonding section of the second unit; the bonding agent is heated, and then the electron emitting members of the electron emission devices are formed. After providing a bonding agent at a bonding section of the second unit, a spacer also may be provided between the bonding agent and the electron emission devices, and then the bonding agent may be heated. In addition, a bonding agent may be provided at a bonding section of the second unit, and then the bonding agent may be heated locally.

7 Claims, 25 Drawing Sheets

STRIPE

MATRIX

METHOD OF MAKING AN IMAGE FORMING APPARATUS

BACKGROUND OF THE INVENTION

1. Field of the Invention

The present invention relates to a method of making an image forming apparatus provided with an electron emission device.

2. Description of the Related Art

Conventional electron emission devices are classified into two types; they are thermion emission devices and cold-cathode electron emission devices. Further, the cold-cathode electron emission devices are classified into field emission types (hereinafter referred to as FE types), metal-insulating layer-metal types (hereinafter referred as MIM types), and surface conductive types.

FE types are disclosed by, for example, W. P. Dyke & W. W. Dolan, "Field Emission" (Advance in Electron Physics, 8, 89 (1956)) and C. A. Spindt, "Physical Properties of thin-film field emission cathodes with molybdenum cones" (J. Appl. Phys., 47, 5248 (1976)). MIM types are disclosed by, for example, C. A. Mead, "Operation of Tunnel-Emission Devices" (J. Appl. Phys., 32, 646 (1961)). Surface conductive type electron emission devices are disclosed by, for example, M. I. Elinson (Radio Eng. Electron Phys., 10, 1290 (1965)).

In the surface conductive type electron emission device, a current flowing parallel to a thin film, having a small area formed on a substrate, causes an electron emission phenomenon. The reported surface conductive type electron emission devices are composed of a $SnO_2$ thin film as disclosed by Elinson, an Au thin film (G. Dittmer: "Thin Solid Films", 9, 317 (1972)), an $In_2O_3/SnO_2$ thin film (M. Hartwell and C. G. Fonstad: "IEEE Trans. ED Conf.", 519 (1975)), and a carbon thin film (Hisashi Araki, et al., *Shinku pk (Vacuum),* 26(1), 22 (1983)).

In conventional surface conductive type electron emission devices, conductive thin films have generally been subjected to an energizing treatment (called "energizing forming") prior to electron emission to form an electron-emitting section. In the energizing forming treatment, a DC voltage or a significantly slowly increasing voltage of, for example, 1 V/min is applied between two ends of the conductive thin film to cause local destruction, deformation or modification of the conductive thin film, and thus to cause formation of an electron-emitting section having high electrical resistance. In the electron-emitting section, cracks form in a part of the conductive thin film, and electrons are emitted near the cracks. After the energizing forming treatment, a surface conductive type electron emission device emits electrons through the electron-emitting section when a voltage is applied to the conductive thin film to cause a current to flow in the device.

Since the surface conductive type electron emission device has a simplified configuration and can be readily formed, many devices can be arranged in a large area. Various applications, such as a charged beam source and a display device, have been studied to utilize such advantages. For example, in electron sources disclosed in Japanese Patent Laid-Open Nos. 64-31332, 1-283749, and 1-257552, surface conductive type electron emission devices are arranged in a matrix having many lines and rows, and devices in the same line are connected to each other at these ends with a lead line (called a common line). In image forming apparatuses such as display devices, planar display devices using liquid crystals have become widespread in place of cathode ray tubes (CRTs); however, those not having spontaneous luminescence inevitably require backlight sources. Accordingly, development of spontaneously luminescent display devices has been eagerly awaited. A typical example of the spontaneously luminescent display device has an electron source comprising an array of many surface conductive type electron emission devices and a fluorescent substance emitting visible light from electrons emerging from the electron source, as disclosed in U.S. Pat. No. 5,066,883.

In a conventional production process, an image forming apparatus using cold-cathode electron emission devices is produced by assembling a rear plate with an electron source composed of an array of cold-cathode electron emission devices, a face plate with a fluorescent substance for emitting visible light, a supporting frame provided outside the display region for maintaining a gap between the rear plate and the face plate, and an evacuation tube. In order to maintain atmospheric pressure, spacers may be used in the display region so as to maintain the gap between the face plate and the rear plate.

A frit compound may be used for adhering the rear and face plates to the supporting frame and spacers. Japanese Patent Laid-Open No. 8-138554 discloses the use of a frit compound to adhere the face and rear plates to the spacers, which are disposed in the display region of an image forming apparatus having a surface conductive type electron emission device in order to hold atmospheric pressure. This patent also discloses that when the frit compound is not applied to the rear plate having electron emission devices, electron emitting characteristics are affected less by the solvent and the binder in the frit compound during calcination of the frit compound.

SUMMARY OF THE INVENTION

One object of the present invention to provide a method of forming an image forming apparatus provided with electron emission devices that has superior electron emitting characteristics, such as a large emitting current.

It is another object of the present invention to provide a method of forming an image forming apparatus provided with a plurality of electron emission devices that has a reduced change in electron emitting characteristics, such as a stable emitting current.

It is still another object of the present invention to provide a method of forming an image forming apparatus that has sufficiently high luminance.

It is a further object of the present invention to provide a method of forming an image forming apparatus that has a reduced change in luminance.

It is a still a further object of the present invention to provide a method of forming an image forming apparatus that has a relatively large area.

A first aspect of the present invention is a method for making an image forming apparatus including an assembly of a first unit provided with an image-forming element and a second unit provided with electron emission devices; the method, includes the steps of providing a bonding agent at a bonding section of the first unit, heating the bonding agent, and then bonding together the first unit and the second unit.

A second aspect of the present invention is a method for making an image forming apparatus including an assembly of a first unit provided with an image-forming element and a second unit provided with electron emission devices in which the method includes the steps of providing a bonding agent at a bonding section of the second unit, heating the bonding agent, and then forming electron emitting members of the electron emission devices.

A third aspect of the present invention is a method for making an image forming apparatus including an assembly of a first unit provided with an image-forming element and a second unit provided with electron emission devices in which the the method includes the steps of providing a bonding agent at a bonding section of the second unit, providing a spacer between the bonding agent and the electron emission devices, and then heating the bonding agent.

A fourth aspect of the present invention is a method for making an image forming apparatus including an assembly of a first unit provided with an image-forming element and a second unit provided with electron emission devices in which the method includes the steps of providing a bonding agent at a bonding section of the second unit, and then locally heating the bonding agent.

Further objects, features and advantages of the present invention will become apparent from the following description of the preferred embodiments with reference to the attached drawings.

DESCRIPTION OF THE PREFERRED EMBODIMENT

The present invention will now be described in detail with reference to the attached drawings.

The basic configurations of the surface conductive type electron emission devices in accordance with the present invention are classified into a horizontal type and a vertical type.

Figure 1A:
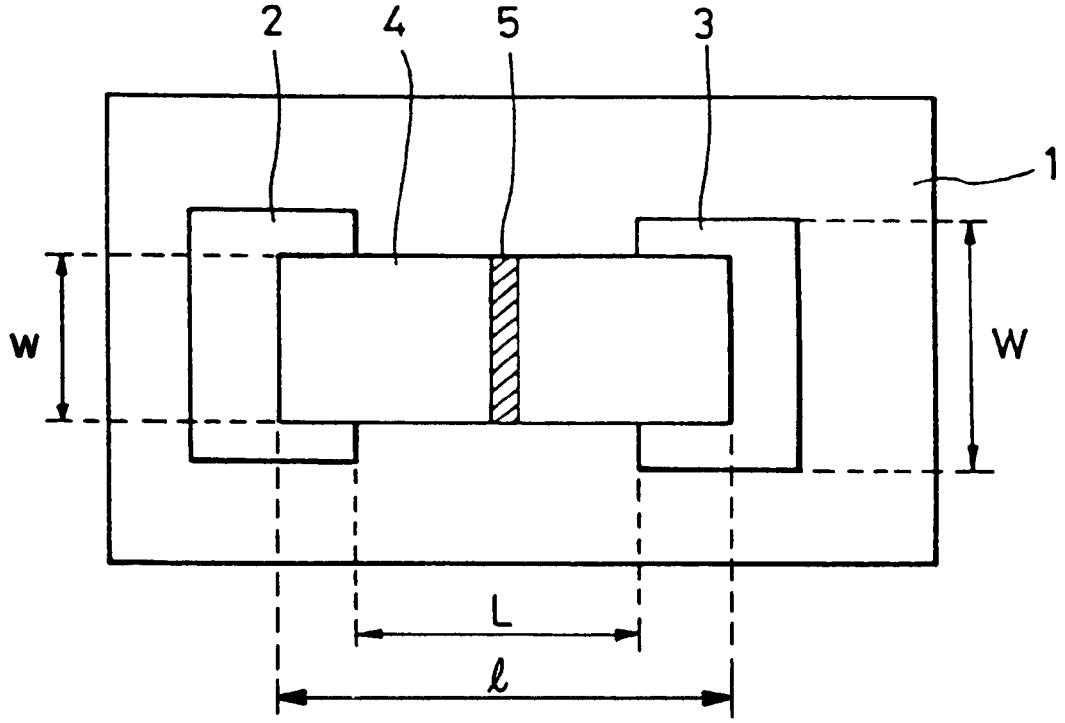
FIGS. 1A and 1B are a schematic plan view and a schematic cross-sectional view, respectively, of a horizontal surface conductive type electron emission device in accordance with the present invention.
Figure 1B:
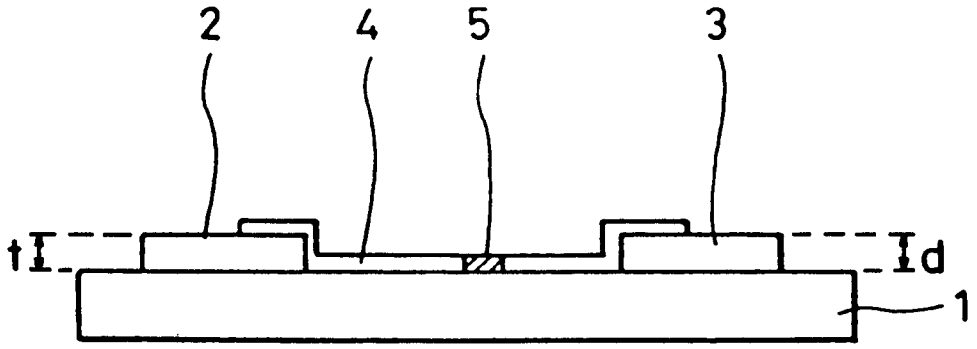

First, a horizontal type electron emission device will be described. FIGS. 1A and 1B are a schematic plan view and a schematic cross-sectional view, respectively, of a horizontal surface conductive type electron emission device in accordance with the present invention. The electron emission device comprises a substrate 1, electrodes 2 and 3 opposing each other, a conductive thin film 4, and an electron emitting section 5.

The substrate 1 may be composed of quartz glass, a purified glass with a reduced content of impurities such as sodium components, a blue flat glass, a glass substrate comprising a blue flat glass and a $SiO_2$ layer deposited thereon by a sputtering process or the like, a ceramic such as alumina, or a Si substrate.

The opposing electrodes 2 and 3 may be composed of a general conductive or semiconductive material. Examples of such materials include metals and alloys thereof, e.g., Ni, Cr, Au, Mo, W, Pt, Ti, Al, Cu, and Pd; printed conductors comprising metals and metal oxides, e.g., Pd, Au, $RuO_2$, and Pd—Ag, printed on substrates such as glass; transparent conductors such as $In_2O_3$—$SnO_2$; and semiconductors such as polysilicon.

The distance L between the electrodes 2 and 3, the length of the electrodes 2 and 3, and the shape of the conductive thin film 4 can be determined in consideration of the state of application of the device. In general, the distance L between the electrodes 2 and 3 is in a range of several thousands of angstroms to several hundreds of micrometers, and preferably several micrometers to several tens of micrometers, in view of the voltage applied to these electrodes 2 and 3. The length W of the electrodes 2 and 3 is in a range of several micrometers to several hundreds of micrometers, in view of the resistance of the electrodes 2 and 3 and the electron emitting characteristics of section 5 of the conductive thin film 4. The thickness d of the electrodes 2 and 3 is in a range of several hundreds of angstroms to several micrometers.

The conductive thin film 4 is preferably composed of a fine-particle thin film containing fine particles having superior electron emitting characteristics. The thickness of the conductive thin film 4 may be determined in consideration of step coverage with respect to the electrodes 2 and 3, the resistance of the electrodes 2 and 3, and the forming conditions will be described below. The thickness is preferably in a range of several angstroms to several thousands of angstroms, and more preferably 10 angstroms to 500 angstroms. The sheet resistance Rs of the electrodes 2 and 3 is in a range of $10^2$ to $10^7$ Ω. The sheet resistance is determined by the equation R=Rs(1/w) wherein R is the resistance, t is the thickness, w is the width, and 1 is the length of the conductive thin film 4. Energizing treatment will be described in the specification as an example of the forming treatment. Of course, other forming methods may be used in the present invention. For example, cracks may be formed in the film to achieve high resistance.

Examples of materials for the conductive thin film 4 include free metals, e.g., Pd, Pt, Ru, Ag, Au, Ti, In, Cu, Cr, Fe, Zn, Sn, Ta, W, and Pb; oxides, e.g., PdO, $SnO_2$, $In_2O_3$, PoO, and $Sb_2O_3$; borides, e.g., $HfB_2$, $ZrB_2$, $LaB_6$, $CeB_6$, $YB_4$, and $GdB_4$; carbides, e.g., TiC, ZrC, HfC, TaC, SiC, and WC; nitrides, e.g., TiN, ZrN, and HfN; semiconductors, e.g., Si and Ge; and carbonaceous substances.

"Fine-particle film" means a film containing a plurality of fine particles. These fine particles can give the film a fine texture by being separately dispersed in the film or agglomerated to form islands. The size of the fine particles is in a range of several angstroms to several thousands of angstroms, and preferably 10 angstroms to 200 angstroms.

The meaning of "fine particle", frequently appearing in the present invention, will now be described. Particles having small diameters are called fine particles, and particles having smaller diameters than the fine particles are called "ultrafine particles". Particles having smaller diameters than the ultrafine particles and comprising several hundreds of atoms are called "clusters". There is no strict boundary between these particles and the clusters, and thus such classification depends on aspects of properties. The "fine particles" in the present invention include both "fine particles" and "ultrafine particles".

The following description is cited from "Experimental Physics Vol. 14—Surface & Fine Particles" (edited by Koreo Kinoshita; published by Kyoritsu Shuppan; Sep. 1, 1986). "Fine particles" in this book have a diameter ranging from 2 to 3 μm to 10 nm, and ultrafine particles have a diameter ranging from 10 nm to 2 to 3 nm. The boundary between the fine particles and the ultrafine particles is not strict and is merely a standard, because both are termed "fine particles" in some cases. Particles comprising two atoms to several tens or several hundreds of atoms are called clusters (page 195, lines 22 to 26).

In addition, according to the definition of "ultrafine particles" in the Hayashi Ultrafine Particle Project of the Research Development Corporation of Japan, the lower limit of the particle size is smaller then the above defined lower limit, as follows. "In the 'Ultrafine Particle Project' of the Creative Scientific Technology Promotion System, particles having a particle size in a range of approximately 1 to 100 nm are called 'ultrafine particles'. Thus, an ultrafine particle is composed of approximately 100 to 108 atoms. From the view point of atoms, ultrafine particles are large particles to giant particles." ("Ultrafine Particles in Creative Scientific Technology" edited by Chikara Hayashi, Ryoji Ueda, and Akira Tazaki, page 2, lines 1 to 4; Mita Shuppan (1988)). "That which is smaller than the ultrafine particle, that is, composed of several to several hundreds of atoms, is generally called a cluster." (Ibid., page 2 lines 12 to 13.) Taking into consideration these descriptions, the "ultrafine particle", as used in this description of the present invention, means an agglomerate composed of many atoms or molecules, and has a lower limit of the particle size in a range of several angstroms to approximately 10 angstroms and an upper limit in a range of several micrometers.

Electron emitting section 5 has highly resistant cracks formed in a part of the conductive thin film 4. The electron emitting section 5 may contain conductive fine particles having a particle size in a range of several angstroms to several hundreds of angstroms in the interior. In such a case, the conductive fine particles may occupy a part of or the entirety of the conductive thin film 4. The electron emitting section 5 and the portions of the conductive thin film 4 that are in its vicinity may contain carbon and/or a carbonaceous material.

Figure 2:
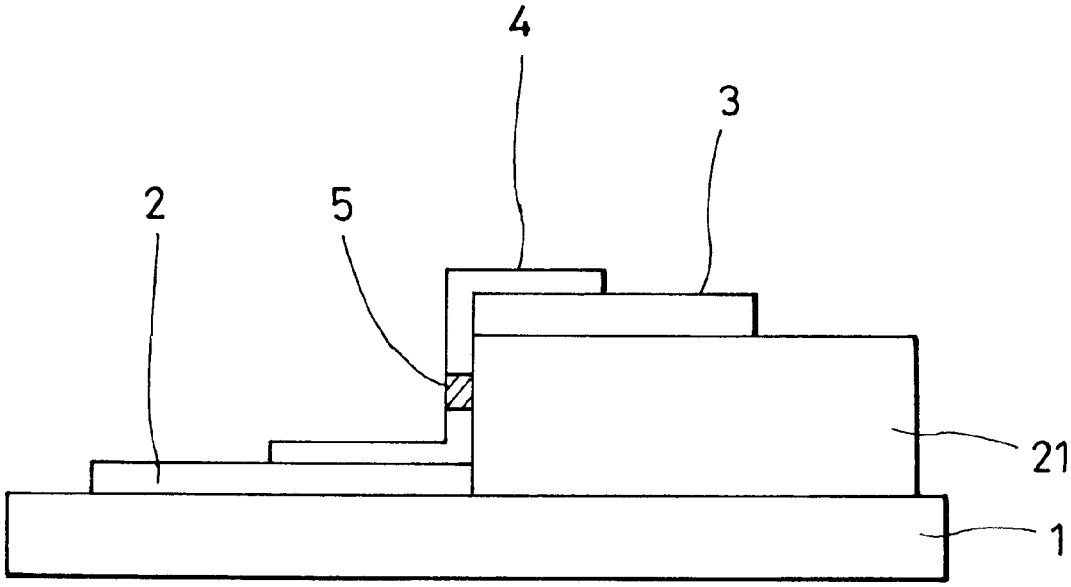
FIG. 2 is a schematic view of a vertical surface conductive type electron emission device in accordance with the present invention.

A vertical surface conductive type electron emission device will now be described. FIG. 2 is a schematic view of a vertical surface conductive type electron emission device in accordance with the present invention. Parts having the same functions as in FIG. 1 are referred to with the same numerals. The device has a step section 21 which is composed of an insulating material, such as $SiO_2$, and is formed by a vacuum deposition process, a printing process, or a sputtering process. This device also has electrodes 2 and 3, a conductive thin film 4, and an electron emitting section 5; these parts are composed of the same materials as those in the above-described horizontal surface conductive type electron emission device. The thickness of the step section 21 corresponds to the interval L between the electrodes 2 and 3 in the horizontal surface conductive type electron emission device and lies in a range of several thousands of angstroms to several tens of micrometers, and preferably in a range of several hundreds of angstroms to several micrometers, in consideration of the method for making the step section 21 and the voltage applied between the electrodes 2 and 3.

After the electrodes 2 and 3 and the step section 21 are formed, the conductive thin film 4 is deposited on the electrodes 2 and 3. Although the electron emitting section 5 is formed on the step section 21 in FIG. 2, the shape and position of the step section 21 depend on the forming conditions.

Figure 3A:
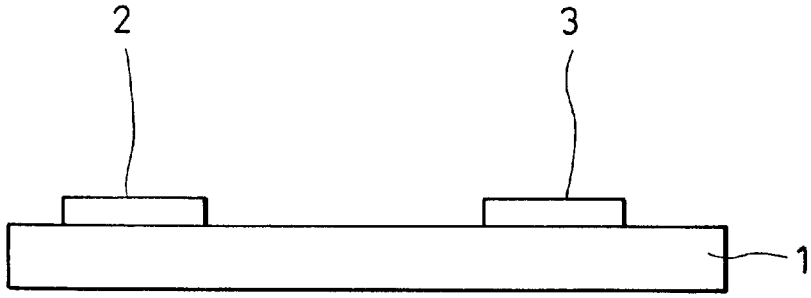
FIGS. 3A to 3C are schematic views showing steps of a method for making a surface conductive type electron emission device.
Figure 3B:
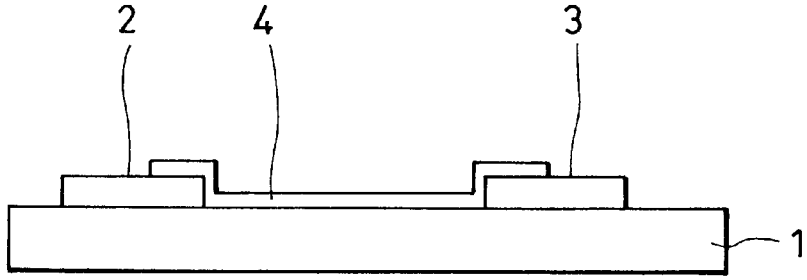
Figure 3C:
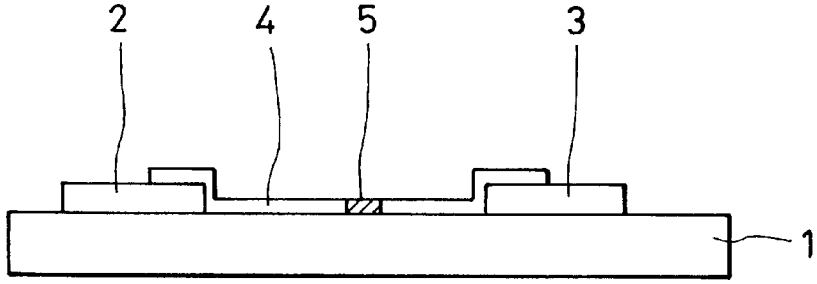

The surface conductive type electron emission device may be produced by various methods. FIGS. 3A to 3C are schematic views showing one of the methods. Parts having the same functions as in FIG. 1 are referred to with the same numerals.

With reference to FIG. 3A, a substrate 1 is thoroughly cleaned with a detergent, purified water or an organic solvent. An electrode material is deposited thereon by a vacuum deposition process or a sputtering process, and then patterned to form external electrodes 2 and 3 by a photolithographic process.

With reference to FIG. 3B, an organometallic solution is applied to the substrate 1 provided with the electrodes 2 and 3 to form an organometallic thin film. The organometallic solution contains an organometallic compound primarily composed of a metal used for the formation of the conductive thin film 4. The organometallic thin film is burned and then patterned by a lift-off or etching process to form a conductive thin film 4. Instead of the coating process, the conductive thin film 4 may also be formed by a vacuum deposition process, a sputtering process, a chemical vapor deposition process, a dispersion coating process, a dipping process, or a spinning process.

With reference now to FIG. 3C, the substrate is subjected to a forming step by an energizing treatment. A current is conducted through the conductive thin film 4 by an electrical power source (not shown in the drawing) to form an electron emitting section 5 having a modified structure in the conductive thin film 4. That is, as a result of the energizing treatment, the conductive thin film 4 has a locally destructed, deformed or modified section. This section functions as an electron emitting section 5.

Figure 4A:
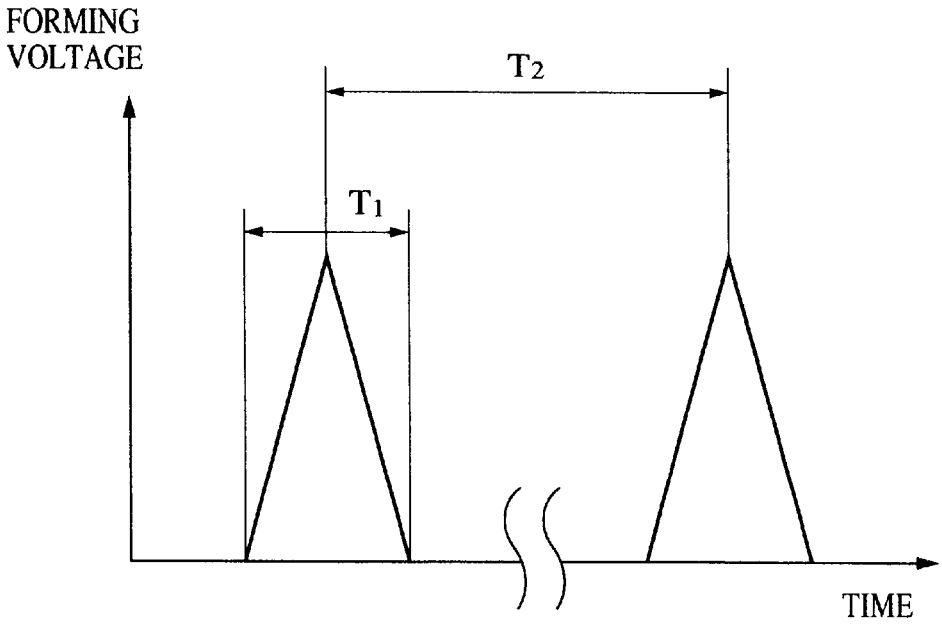
FIGS. 4A and 4B are graphs of waveforms of pulse voltages applied in the energizing forming treatment.
Figure 4B:
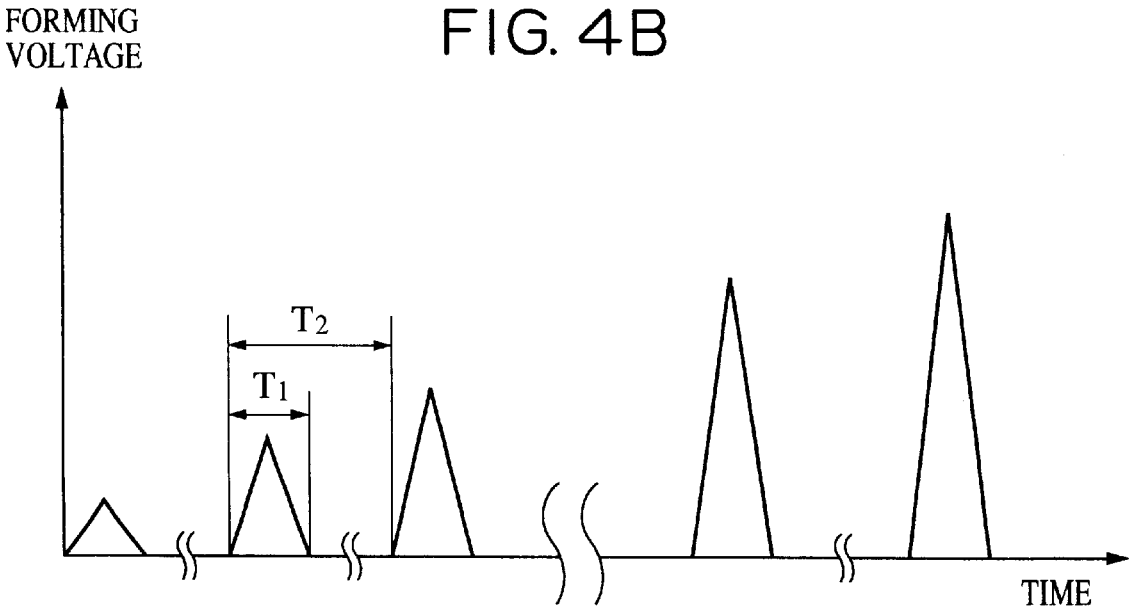

FIGS. 4A and 4B are graphs of waveforms of pulse voltages applied in the energizing forming treatment.

As shown in FIGS. 4A and 4B, pulse voltages are preferable. In FIG. 4A, pulses having a constant voltage are continuously applied, whereas in FIG. 4B, pulses having gradually increasing voltages are continuously applied. In FIGS. 4A and 4B, T1 represents the pulse width and T2 represent the pulse interval. In the method shown in FIG. 4A, the pulse width T1 lies in a range of 1 microsecond to 10 milliseconds, and the pulse interval T2 lies in a range of 10 microseconds to 100 milliseconds. The height of the triangular waves or the peak voltage in the energizing forming treatment is determined based on the type of the surface conductive electron emission device. The pulses are generally applied for a period of time ranging from several seconds to several tens of minutes under such conditions. Any other pulse waves other than triangular waves, for example, rectangular waves also may be used.

In the method shown in FIG. 4B, the height of the triangular waves is increased by, for example, 0.1 V for each pulse.

The energizing forming treatment is performed before the conductive thin film 4 has a predetermined desired resistance value. The resistance is measured as follows. A low voltage, not causing local destruction or deformation, is applied to the conductive thin film 4 during a pause time between the pulses, that is, during the pulse interval T2 and the conducted current is measured. For example, a voltage of approximately 0.1 volts is applied to cause a detectable current to flow in the conductive thin film 4. When the resistance reaches 1 MΩ or more, the energizing forming treatment is complete.

After the forming treatment the device is preferably subjected to an activation step. The device current If and the emission current Ie significantly change during the activation step. In the activation step, pulses are repeatedly applied in an organic gas atmosphere, as in the energizing forming treatment. The organic gas atmosphere is formed by introducing an organic gas into a vacuum that has been created using an ion pump.

Examples of suitable organic gas materials include aliphatic hydrocarbons, such as alkanes, alkenes, and alkynes; alcohols; aldehydes; ketones; amines; and organic acids, such as phenol, carboxylic acids, and sulfonic acids. Examples of these compounds include saturated hydrocarbons represented by $C_nH_{2n+2}$, e.g., methane, ethane, and propane; unsaturated hydrocarbons represented by $C_nH_{2n}$, i.e., ethylene and propylene; and other compounds, i.e., benzene, toluene, methanol, ethanol, formaldehyde, acetaldehyde, acetone, methyl ethyl ketone, methylamine, ethylamine, phenol, formic acid, acetic acid, and propionic acid.

Carbon and/or a carbonaceous material derived from the atmospheric organic material are deposited on the device during the activation step, and they cause significant changes in the device current If and the emission current Ie. The activation step is completed when the device current If and the emission current Ie reach predetermined values. The pulse width, the pulse interval, and the pulse height are appropriately determined.

Herein, the term "carbon and/or a carbonaceous material" includes, for example, graphites, such as highly orientated pyrolytic graphite (HOPG), pyrolytic graphite (PG) and graphitizing carbon (GC), and amorphous carbon. HOPG has a crystal structure composed of substantially complete graphite. PG has a slightly disordered crystal structure having a crystal grain size of approximately 200 angstroms. GC has a considerably disordered crystal structure having a crystal grain size of approximately 20 angstroms. The term "amorphous carbon" is here meant to include mixtures of amorphous carbon and microcrystalline graphite. The thickness of the carbon and/or the carbonaceous material is preferably 500 angstroms or less, and more preferably 300 angstroms or less.

The electron emission device is preferably subjected to a stabilizing step. In the stabilizing step, the organic material in the vacuum chamber is evacuated. An oil-free evacuation unit is preferably used for evacuating the vacuum chamber, since oil affects characteristics of the device. Examples of such evacuation units include sorption pumps and ion pumps.

It is preferable that the partial pressure of the organic component in the vacuum chamber be $1.3\times10^{-8}$ Torr or less, and more preferably $1\times10^{-10}$ Torr or less, so that the carbon and/or carbonaceous material do not further deposit in this step. It is preferable that the vacuum chamber be heated during the evacuation step so that organic molecules adsorbed on the inner wall of the vacuum chamber and in the electron emission device are easily removed and evacuated. Heating is preferably performed at a temperature of 80 to 200° C. for 5 hours or more. The heating conditions, however, may be changed without restriction, depending on the size and shape of the vacuum chamber and the configuration of the electron emission device. The pressure in the vacuum chamber must be decreased as much as possible, and is preferably $1.3\times10^{-7}$ Torr or less, and more preferably $1\times10^{-8}$ Torr or less.

It is preferable that the atmosphere in the stabilizing step be maintained in a driving mode of the electron emission device. Sufficiently stable characteristics, however, can be achieved as long as the organic components are sufficiently removed even when the degree of the vacuum is slightly decreased. As a result, the device current If and the emission current Ie can be stabilized.

Figure 5:
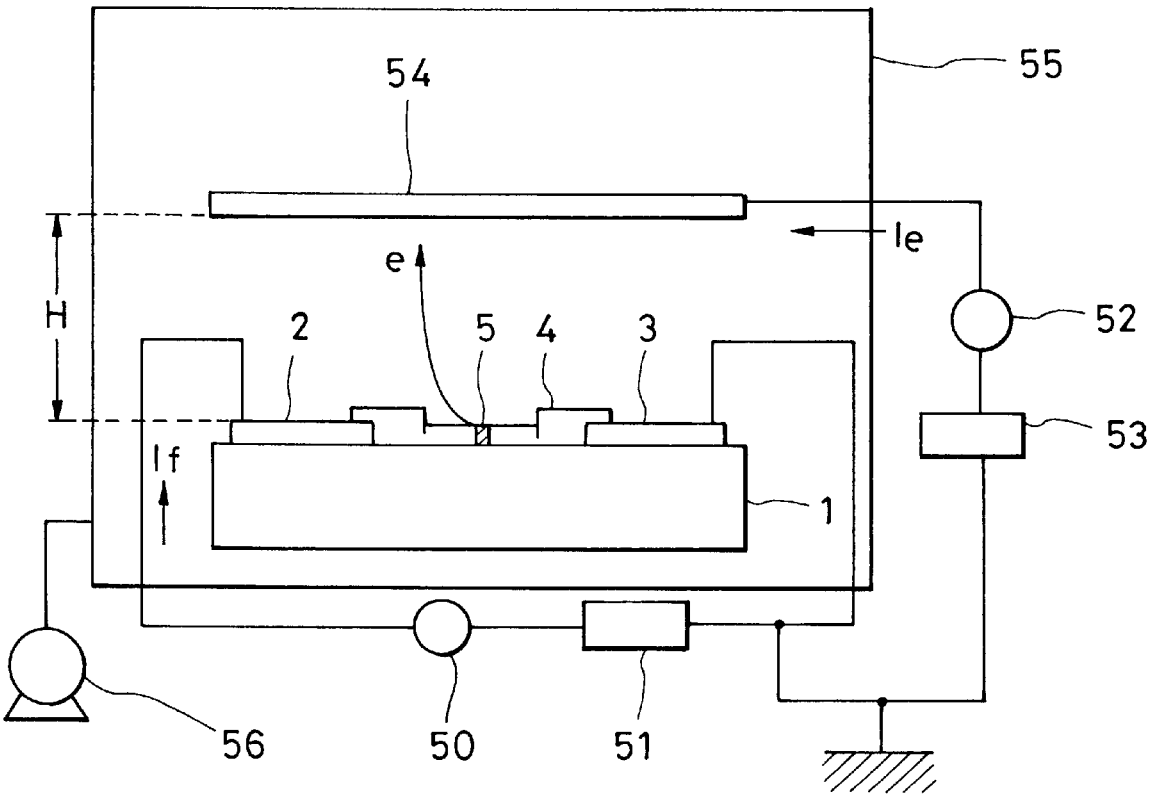
FIG. 5 is a schematic view of a vacuum unit.

Fundamental characteristics of the electron emission device in accordance with the present invention will now be described with reference to FIGS. 5 and 6. FIG. 5 is a schematic view of a vacuum unit that also functions as a measuring unit. Parts having the same functions as in FIG. 1 are referred to with the same numerals. In FIG. 5, the vacuum unit has a vacuum chamber 55 and a vacuum pump 56. An electron emission device is placed into the vacuum chamber 55. The vacuum unit further has an electrical power source 51 for applying a device voltage Vf to the electron emission device, and an ammeter 50 for detecting a device current If flowing in a conductive thin film 4 between electrodes 2 and 3, and an anode 54 for collecting an emission current Ie from the electron emitting section 5. A voltage is applied to the anode 54 through a high-voltage electrical power source 53. An ammeter 52 detects the emission current Ie from the electron emitting section 5.

Measurement is performed, for example, at a voltage of the anode of 1 kV to 10 kV, and a distance H between the anode and the electron emission device of 2 to 8 mm.

The vacuum chamber 55 is provided with a vacuum indicator (not show in the drawing) and required instruments for the measurement. The vacuum pump 56 has a gas inlet section (not shown in the drawing) to control the atmosphere in the vacuum chamber. The vacuum unit can be heated to 200° C. by a heater (not shown in the drawing). Thus, the vacuum unit is capable of performing the steps of the energizing forming treatment.

Figure 6:
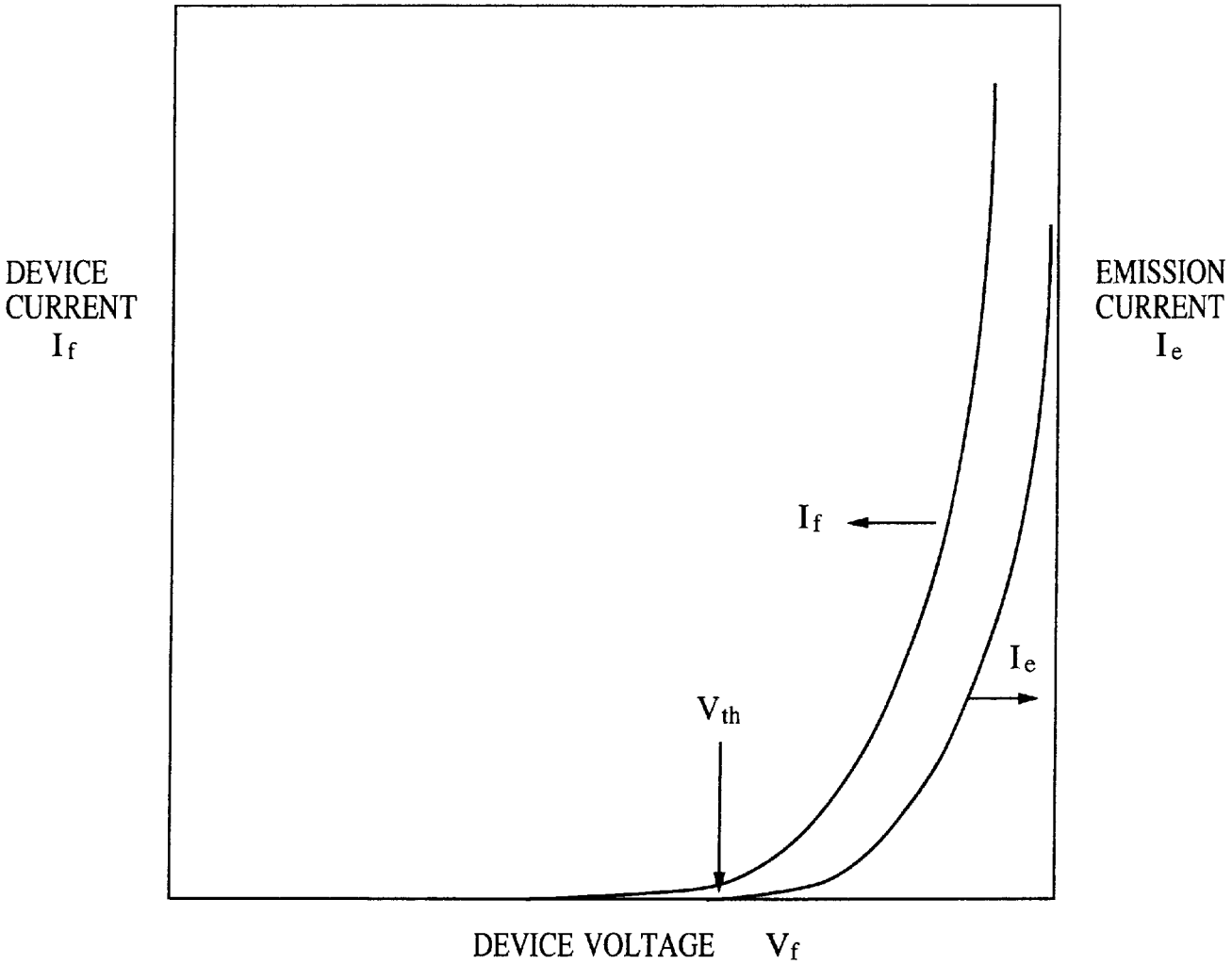
FIG. 6 is a schematic graph showing the relationship between the emission current Ie or device current If and the device voltage Vf that are measured by a vacuum unit.

FIG. 6 is a schematic graph showing the relationship between the emission current Ie or device current If and the device voltage Vf that are measured by the vacuum unit. Since the discharging voltage Ie is significantly smaller than the device voltage If, these voltages are expressed by arbitrary units in FIG. 6. Linear scales express the vertical axis and the horizontal axis. As shown in FIG. 6, the surface conductive type electron emission device in accordance with the present invention has the following three characteristics regarding the emission current Ie.

(1) The emission current Ie steeply increases for an applied voltage higher than a threshold voltage Vth (see FIG. 6), whereas the emission current Ie is not substantially detected for a device voltage lower than the threshold voltage Vth. Thus, the device is of a nonlinear type having a distinct threshold voltage Vth with respect to the emission current Ie.

(2) Since the emission current Ie shows a monotone increase as the device voltage Vf increases, the device voltage Vf can control the emission current Ie.

(3) The amount of charge collected in the anode 54 changes with the application time of the device voltage Vf. In other words, the application time of the device voltage Vf controls the charges collected in the anode 54.

As described above, in the surface conductive type electron emission device in accordance with the present invention, electron emitting characteristics can be readily controlled in response to the input signal. Such characteristics permit the application of the device in various fields, for example, an electron source and an image forming apparatus including an array of a plurality of electron emission devices.

FIG. 6 shows a monotone increase in the device current If with respect to the device voltage Vr (hereinafter referred to as an MI characteristic). Some devices have a voltage-controlled negative resistance characteristic (hereinafter referred to as a VCNR characteristic), although this is not shown in the drawings. The characteristics of the device can be determined by controlling the above-mentioned steps.

Examples of applications of the electron emission device in accordance with the present invention will now be described. As described above, an electron source and an image forming apparatus can be produced by arranging a plurality of surface conductive type electron emission devices in accordance with the present invention onto a substrate.

The electron emission devices can have various types of arrangements. For example, in a ladder arrangement, many lines of electron emission devices are arranged in the line direction, and control electrodes or grids for controlling electrons from these electron emission devices are disposed on the electron emission devices in a direction perpendicular to the line (i.e., in a row direction). In a simple matrix arrangement, electron emission devices are arranged in a matrix in the X and Y directions. One of the electrodes of each electron emission device is connected to a common lead in the X direction, and the other electrode of each electron emission device is connected to a common lead in the Y direction.

The simple matrix arrangement will now be described in more detail. The surface conductive type electron emission device in accordance with the present invention has the above-mentioned three characteristics. That is, electrons discharged from the surface conductive type electron emission device can be controlled by the height and width of the pulse voltage for a voltage higher than the threshold voltage; however, at voltages lower than the threshold voltage a substantial number of electrons are not discharged. When many electron emission devices are arranged, a pulse voltage applied to each device can control electrons discharged from the device.

Figure 7:
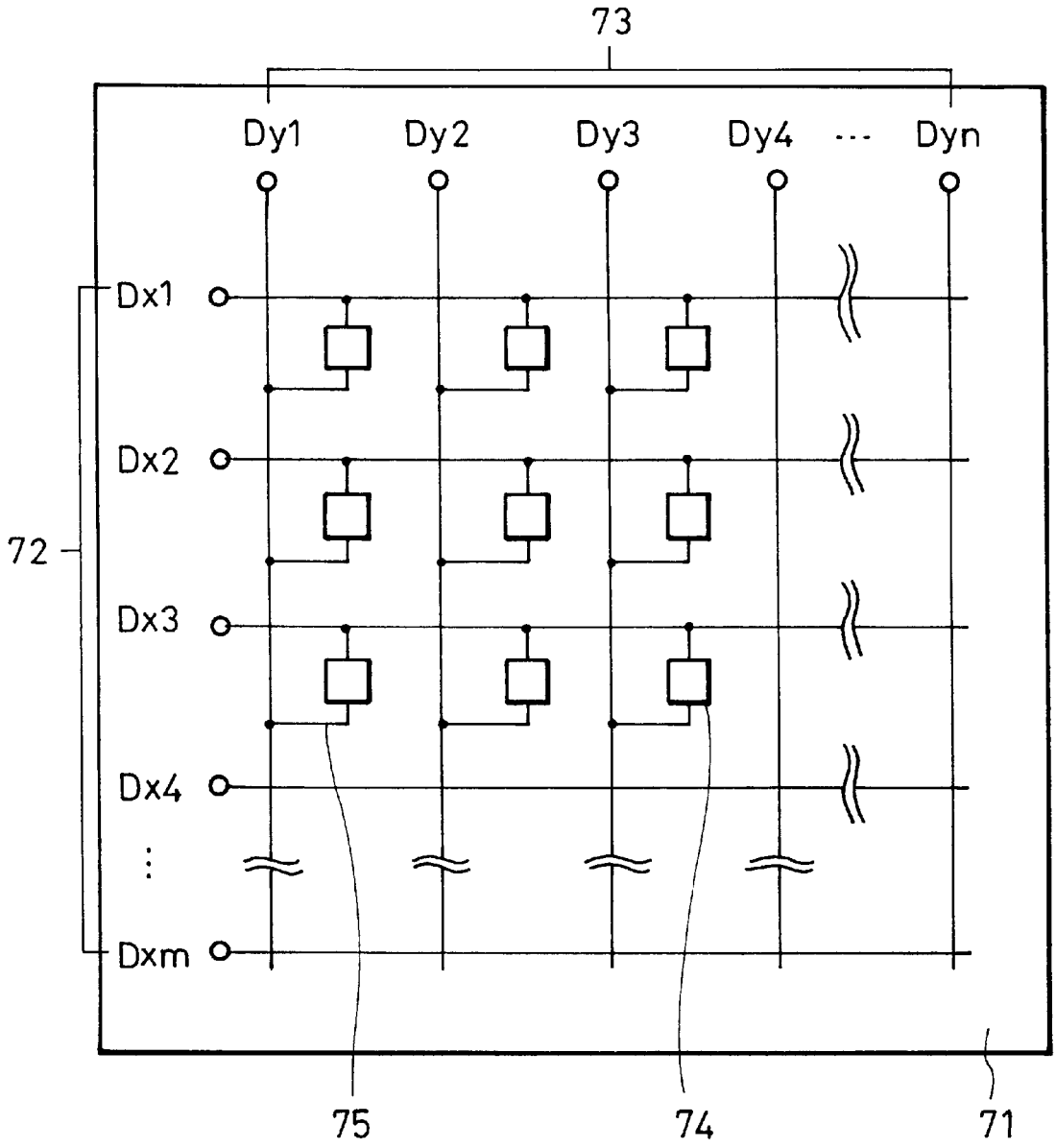
FIG. 7 is a schematic view of an electron source configuration in a simple matrix arrangement.

Based on this principle, a substrate for an electron source (or an electron source substrate) having an array of a plurality of electron emission devices in accordance with the present invention will now be described with reference to FIG. 7. X-axis lead lines 72, including DX1 and DX2 to DXm (wherein m is a positive integer) are composed of a conductive material such as a free metal and are formed on an electron source substrate 71 by a vacuum deposition, printing, or sputtering process. The material, thickness, and width of the lead lines can be appropriately determined depending on the purpose. Y-axis lead lines 73, including DY1 through DYn (wherein n is a positive integer), are also formed as in the X-axis lead lines 72. The X-axis lead lines 72 are electrically isolated from the Y-axis lead lines 73 by an insulating interlayer (not shown in the drawing) provided therebetween. The insulating interlayer is composed of, for example, $SiO_2$, and formed by a vacuum deposition, printing, or sputtering process on a part or the entirety of the electron source substrate 71. The material and process for, and the shape and thickness of, the insulating interlayer are determined such that the insulating interlayer has durability to a potential difference between the X-axis lead lines 72 and the Y-axis lead lines 73. One end of each X-axis lead line 72 and one end of each Y-axis lead line 73 are extracted as external terminals.

Each of the surface conductive type electron emission devices 74 in a matrix (m×n) is connected to the corresponding X-axis lead line 72 and the corresponding Y-axis lead line 73 through a pair of electrodes (not shown in the drawing) provided on the two ends of the surface conductive type electron emission device and a connecting line 75 composed of a conductive metal or the like. The surface conductive type electron emission device 74 may be of a horizontal type or a vertical type. These lines 72, 73, and 74 and the electrodes may be composed of partially or substantially the same conductive material, or of different conductive materials.

The X-axis lead lines 72 are connected to a scanning signal application means (not shown in the drawing). The scanning signal application means apply scanning signals for selecting lines of the surface conductive type electron emission devices 74 arranged in the X direction. The Y-axis lead lines 73 are connected to a modulation signal application means (not shown in the drawing). The modulation signal application means apply modulation signals to the rows of the surface conductive type electron emission devices 74 arranged in the Y direction in response to the input signals. A driving voltage applied to each electron emission device corresponds to a differential potential between the scanning signal and the modulation signal applied to the device.

In such a configuration, a simple matrix wiring system can independently drive individual electron emission devices. An image forming apparatus using an electron source having a simple matrix arrangement will be described with reference to FIGS. 8A, 8B, 9A, 9B, and 10.

Figure 8A:
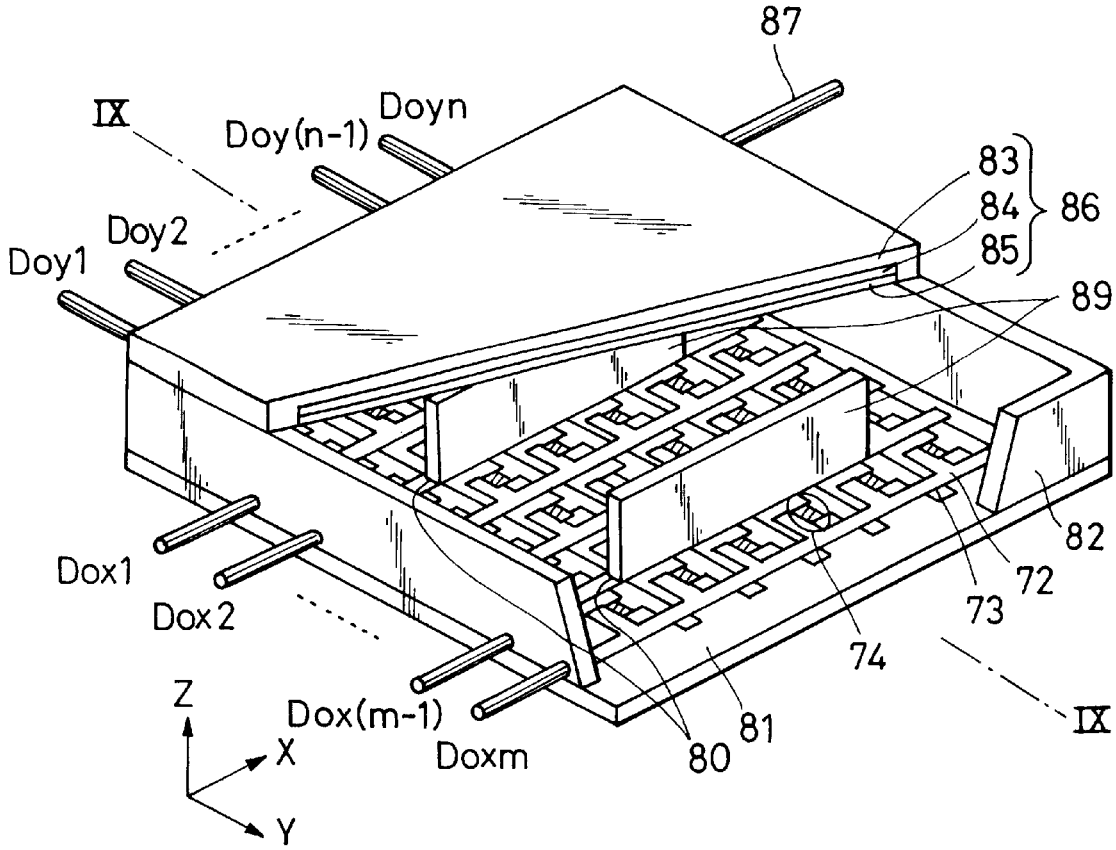
FIG. 8A is a schematic isometric view of a display panel of an image forming apparatus.
Figure 8B:
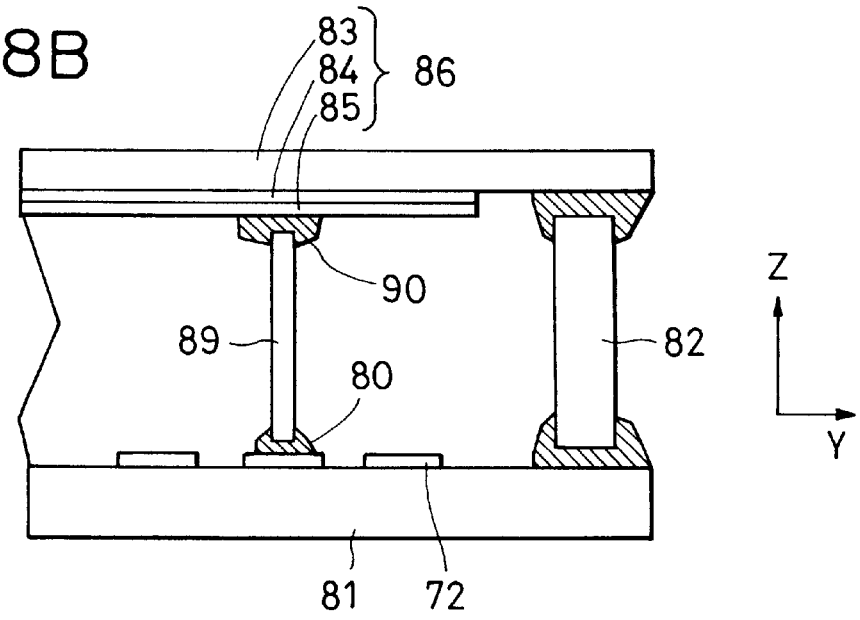
FIG. 8B is a cross-sectional view taken along line IX—IX of FIG. 8A.

FIG. 8A is a schematic isometric view of a display panel of an image forming apparatus, and FIG. 8B is a cross-sectional view taken along line IX—IX of FIG. 8A. With reference to FIG. 8A, numeral 81 represents an electron source substrate as a rear plate provided with a matrix of surface conductive type electron emission devices 74 as shown in FIG. 1, and numerals 72 and 73 represent an X-axis lead line and a Y-axis lead line, respectively, connected to a pair of electrodes in each electron emission device. Numeral 86 represents a face plate in which a fluorescent film 84 and a metal back layer 85 are formed on the inner face of a glass substrate 83. Numeral 82 represents a frame which is connected to the rear plate 81 and the face plate 86. Numeral 89 represents a spacer provided in the display region for reinforcing the strength of the electron source substrate 81. The number and shape of the spacer 89 may be appropriately determined.

With reference to FIG. 8B, the rear plate 81, the face plate 86, the frame 82, the spacer 89, and other units such as an exhaust pipe (not shown in the drawing) are connected with frit glass 80 and 90. In these drawings, although the rear plate 81 functions as the electron source substrate, an electron source substrate may be provided in addition to the rear plate 81. The spacer 89 in the display region may be omitted, if the package has sufficient strength.

Assembly of the image forming apparatus will now be described. First, a frit compound is applied onto predetermined positions for connecting the above-mentioned units (first step). The frit compound is composed of frit glass and a vehicle. The frit glass is powdered and is composed of a main component, such as PbO, PbO—$B_2O_3$, or PbO—ZnO—$B_2O_3$, and a filler, such as $SnO_2$. The frit glass may be a crystalline frit glass or a composite mixture of a crystalline frit glass and an amorphous frit glass.

The vehicle is composed of at least one component. Components which can disperse frit glass and can maintain the shape of the frit glass until the softening point are called binders (organic binders). Examples of binders include nitrocellulose, ethyl cellulose, and polyisobutyl methacrylate. The vehicle also may contain a solvent for dispersing the frit glass and dissolving the binder. Examples of such solvents include amyl acetate, terpineol, and other volatile alcohol and ether solvents. The frit compound may be applied with a dispenser or by a spraying or printing process.

In the second step, components other than the frit glass are removed from the applied frit compound. This step is called a calcination step. The calcination step is performed at a temperature which is lower than the softening point of the frit glass and higher than the pyrolytic temperature of the vehicle or binder. A drying step may be incorporated prior to the calcination step for selectively or partially removing the solvent.

The third step is a sealing step in which the relevant units are connected to each other with the frit glass. The sealing temperature is determined so that the frit glass has sufficient flowability to connect the relevant units. The relevant units are positioned and then connected in the sealing step. The calcination step and the sealing step may be simultaneously performed in the present invention.

The second or calcination step of the present invention is performed so that the electron emitting section or the conductive thin film of the electron source substrate is exposed to evolved gas. Thus, in the first step, the frit compound will be applied, followed by calcination, to the units connected to the electron source substrate, such as the face plate, the frame, and the spacer, in place of the electron source substrate, in some cases.

When the frit compound is applied onto the electron source substrate in the first step, the conductive thin film or the electron emitting section may be formed after the second step. When the frit compound is applied, followed by calcination, onto the electron source substrate in the first step after the formation of the electron emitting section or the conductive thin film, a barrier may be provided in the second step for isolating the electron emitting section or the conductive thin film from the application section of the frit compound.

When the frit compound is applied, followed by calcination, onto the electron source substrate after the formation of the electron emitting section or the conductive thin film, the electron emitting section or the conductive thin film of the electron source substrate is maintained at a low temperature in the second step such that the conductive thin film is not altered by the evolved gas. Thus, the application section of the frit compound may be locally heated by a heater or an optical heater using infrared rays or laser light.

Figure 9A:
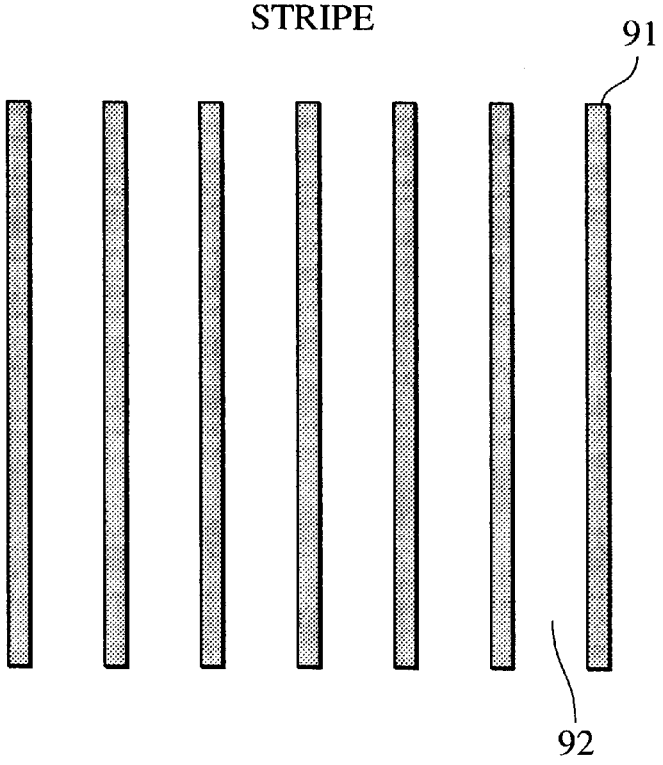
FIGS. 9A and 9B are schematic views of fluorescent films used in image forming apparatuses.
Figure 9B:
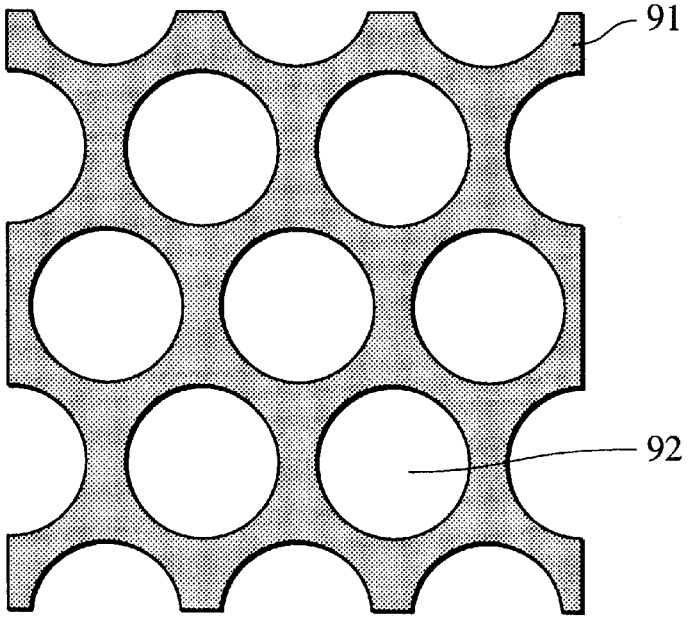

FIGS. 9A and 9B are schematic views of fluorescent films. A monochrome fluorescent film may comprise only a fluorescent substance 92. A colored fluorescent film may comprise conductive black stripes 91 (in FIG. 9A) or a conductive black matrix 91 (in FIG. 9B) and fluorescent substances 92 depending on the arrangement of the fluorescent substances. The black stripe or matrix prevents mixing between adjacent fluorescent substances 92 corresponding to three primary colors and suppression of the contrast due to reflection of external light by the fluorescent film. The material for the black stripe or matrix contains graphite as a main component or a component having low light transmittance and reflection.

With reference to FIG. 8A, the monochrome or color fluorescent substance may be applied onto a glass substrate 83 to form a fluorescent film 84 by a precipitation or printing process. A metal back layer 85 is generally provided on the inner face of the fluorescent film 84. The metal back layer 85 serves as a mirror and reflects light emitted from the fluorescent substance towards the face plate 86 and thus improves luminance. Also, the metal back layer 85 functions as an electrode for applying an electron beam acceleration voltage and protects the fluorescent substance from damage due to collision of negative ions occurring in the package. The metal back layer 85 is generally formed by depositing aluminum by a vacuum deposition process onto the inner surface of the fluorescent film 84 after smoothing treatment (generally called "filming") of the inner surface.

The face plate 86 may be provided with a transparent electrode (not shown in the drawing) at the outer face of the fluorescent film 84 in order to enhance conductivity of the fluorescent film 84.

In a color system, fluorescent substances and electron emission devices must be exactly aligned before sealing.

The image forming apparatus shown in FIGS. 8A and 8B is produced as follows. The package comprising the face plate 86, the rear plate 81, and the frame 82 is heated and evacuated by an oil-free evacuation system, such as an ion pump or a sorption pump, through an evacuation pipe (not shown in the drawings) attached to the package to an atmosphere that has a vacuum pressure of $10^{-7}$ Torr and is substantially free of organic substances. The package is then sealed, and is subjected to getter treatment, if necessary. In the getter treatment, a getter (not shown in the drawings) provided at a given position in the package is heated immediately before or after the sealing of the package to deposit a film by evaporation. The getter is generally composed of barium, and the film has adsorption effects so that the package is maintained at a vacuum pressure in a range of $1\times10^{-5}$ to $1\times10^{-7}$ Torr. Steps subsequent to the forming treatment of the surface conductive type electron emission devices can be appropriately provided.

Figure 10:
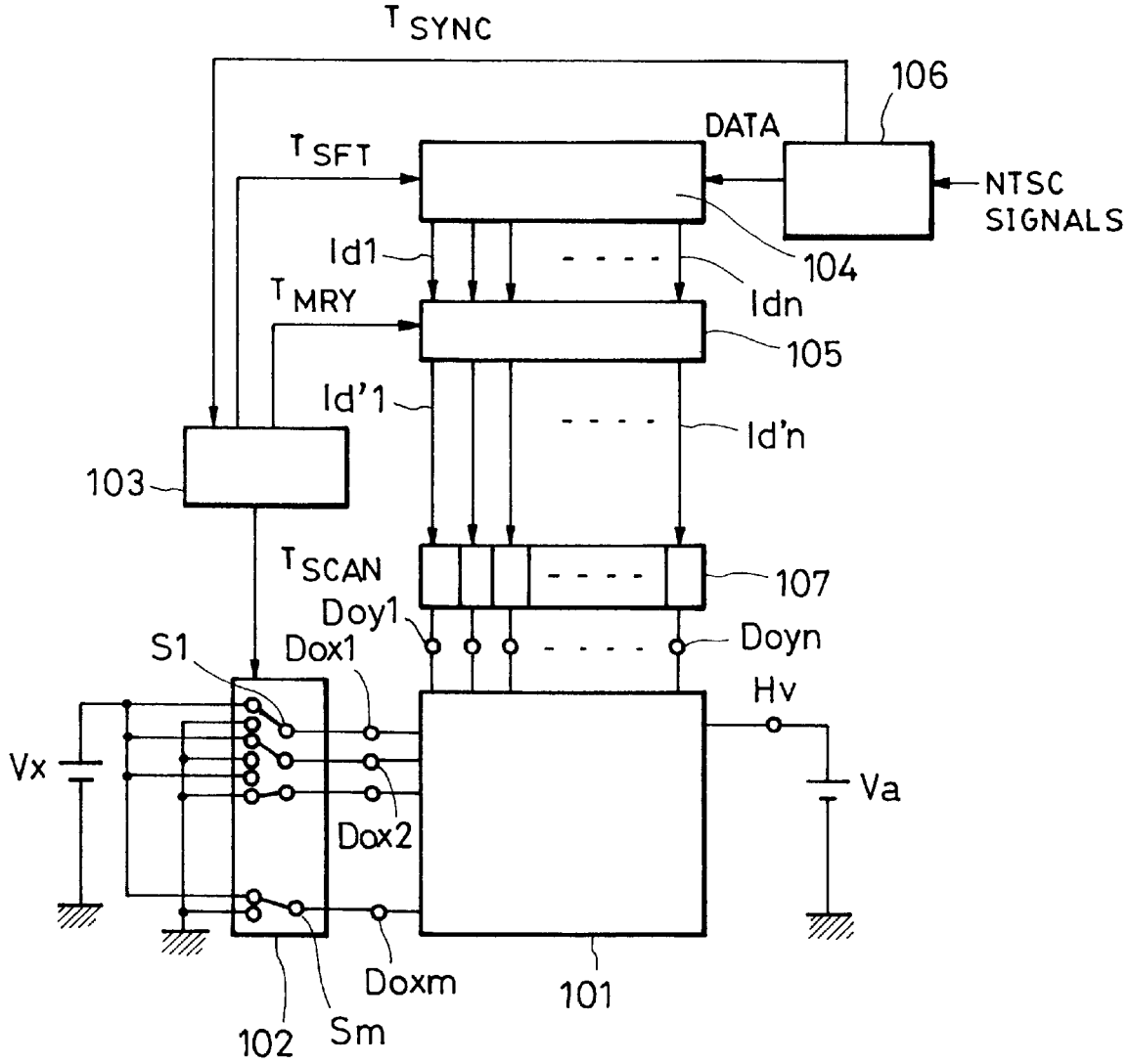
FIG. 10 is a block diagram of a driving circuit for an NTSC television display.

FIG. 10 is a block diagram of a driving circuit for a television display on the basis of NTSC signals having a display panel including an electron source having a simple matrix arrangement. The circuit diagram comprises an image display panel 101, a scanning circuit 102, a control circuit 103, a shift register 104, a line memory 105, a synchronous separation circuit 106, a modulation signal generator 107, and DC voltage sources Vx and Va.

The display panel 101 is connected to an external electrical circuit through terminals Dox1 to Doxm and Doy1 to Doyn and a high voltage terminal Hv. Scanning signals are applied to the terminals Dox1 to Doxm for driving the electron source provided in the display panel, that is, for driving each line (including N devices) sequentially of a matrix (M×N) of surface conductive type electron emission devices. Modulation signals are applied to the terminals Doy1 to Doyn for controlling the intensity of the electron beam output from each electron emission device. A DC voltage of, for example, 10 kV is applied to the high-voltage terminal Hv through the DC voltage source Va. The DC voltage corresponds to an acceleration voltage that accelerates the electron beams emitted from the surface conductive type electron emission devices to a level capable of exciting the fluorescent substance.

The scanning circuit 102 has M switching elements S1 to Sm therein, as shown schematically in the drawing. Each switching element selects either an output voltage from the DC voltage source Vx or a ground level (0 volts), and is connected to each of the terminals Dx1 to Dxm in the display panel 201. The switching elements S1 to Sm operates based on the control signals Tscan output from the control circuit 103. Each switching element comprises, for example, an FET. The DC voltage source Vx outputs a constant voltage so that the driving voltage applied to the unscanned devices, on the basis of the characteristics of the surface conductive type electron emission device, is lower than the threshold voltage of electron emission.

The control circuit 103 controls matching of individual units so that a desired display is achieved based on image signals from the exterior. The control circuit 103 generates control signals Tscan, Tsft, and Tmry in response to synchronous signals Tsync sent from the synchronous separation circuit 106. The synchronous separation circuit 106 separates the NTSC television signals from the exterior into synchronous signal components and luminance signal components, and comprises a typical frequency separation circuit (filter). The synchronous signal components include vertical synchronous signals and horizontal synchronous signals, and are represented by "Tsync" in the present invention. The luminance signal components are represented by "DATA signal". The DATA signals enter the shift resister 104.

The shift resister 104 serial/parallel-converts the DATA signals input in time series corresponding to each line of the image, and operates in response to the control signal Tsft from the control circuit 103. In other words, the control signal Tsft functions as a shift clock for the shift register 104. The serial/parallel-converted data corresponding to one line of the image is output as a N parallel signals Id1 to Idn from the shift register 104 to drive N electron emission devices.

The line memory 105 temporally stores N data Ida to Idn corresponding to one line of the image under the control of the control signal Tmry sent from the control circuit 103. The stored data is output as I'd1 to K'dn to the modulation signal generator 107.

The modulation signal generator 107 produces output signals for driving the surface conductive type electron emission devices in response to the image data I'd1 to I'dn. The output signals are applied to the surface conductive type electron emission devices in the display panel 201 through the terminals Doy1 to Doyn.

As described above, the electron emission device in accordance with the present invention has the following fundamental characteristics with respect to the emission current Ie. Electron emission occurs when a voltage larger than the threshold voltage Vth is applied to the device, and the emission current, that is, the intensity of the electron beams, varies with voltages higher than the threshold voltage Vth. Electron emission does not occur at an applied voltage lower than the threshold voltage Vth. When a pulse voltage higher than the threshold voltage Vth is applied, the intensity of the emitted electron beams is controlled by the pulse height Vm. The total amount of the electron beams is also controlled by the pulse width Pw.

Examples of modulation systems for the electron emission devices in response to the input signals include a voltage modulation system and a pulse width modulation system. The voltage modulation system uses a modulation signal generator 107, including a voltage modulation circuit that modulates the height of the voltage pulse having a predetermined length in response to the input data. The pulse width modulation system uses a modulation signal generator 107, including a pulse width modulation circuit that modulates the width of the voltage pulse having a predetermined height in response to the input data.

The shift register 104 and the line memory 105 may be of digital signal types or analog signal types, as long as serial/parallel conversion of the image signals is performed within a predetermined time. When digital signal type shift register 104 and line memory 105 are used, the output signal DATA from the synchronous separation circuit 106 must be digitized using an A/D converter provided at the output section of the synchronous separation circuit 106. The circuit in the modulation signal generator 107 is different between the digital signals and analog signals from the line memory 105. For example, in a voltage modulation system by digital signals, the modulation signal generator 107 has a D/A conversion circuit and an amplification circuit, if necessary. In a pulse width modulation system, the modulation signal generator 107 has a high-speed oscillator, a counter for counting the wave number output from the oscillator, and a comparator for comparing the output value from the counter with the output value from the memory. The modulation signal generator 107 may have an amplifier for voltage-amplifying the pulse width modulated signals from the comparator up to a driving voltage of the surface conductive type electron emission device.

In the voltage modulation system by analog signals, the modulation signal generator 107 has an operational amplifier, and a level shift circuit, if necessary. In the pulse width modulation system, the modulation signal generator 107 has a voltage-controlled oscillator (VCO), and an amplifier, if necessary, for voltage-amplifying the pulse width modulated signals up to a driving voltage of the surface conductive type electron emission device.

In such an image forming apparatus in accordance with the present invention, each electron emission device emits electron beams in response to the voltage applied to the device through the external terminals Dox1 to Doxm and Doy1 to Doyn. The electron beams are accelerated by a high voltage applied to the metal back layer 85 or a transparent electrode (not shown in the drawing) through the high-voltage terminal Hv. The accelerated electron beams collide with the fluorescent film 84 to form a fluorescent image.

A variety of modifications in the configuration of the image forming apparatus are available within the technical concept of the present invention. For example, the input signal may be of a PAL system, a SECAM system, or a high-definition TV system, such as a MUSE system, having a larger number of scanning lines.

Figure 11:
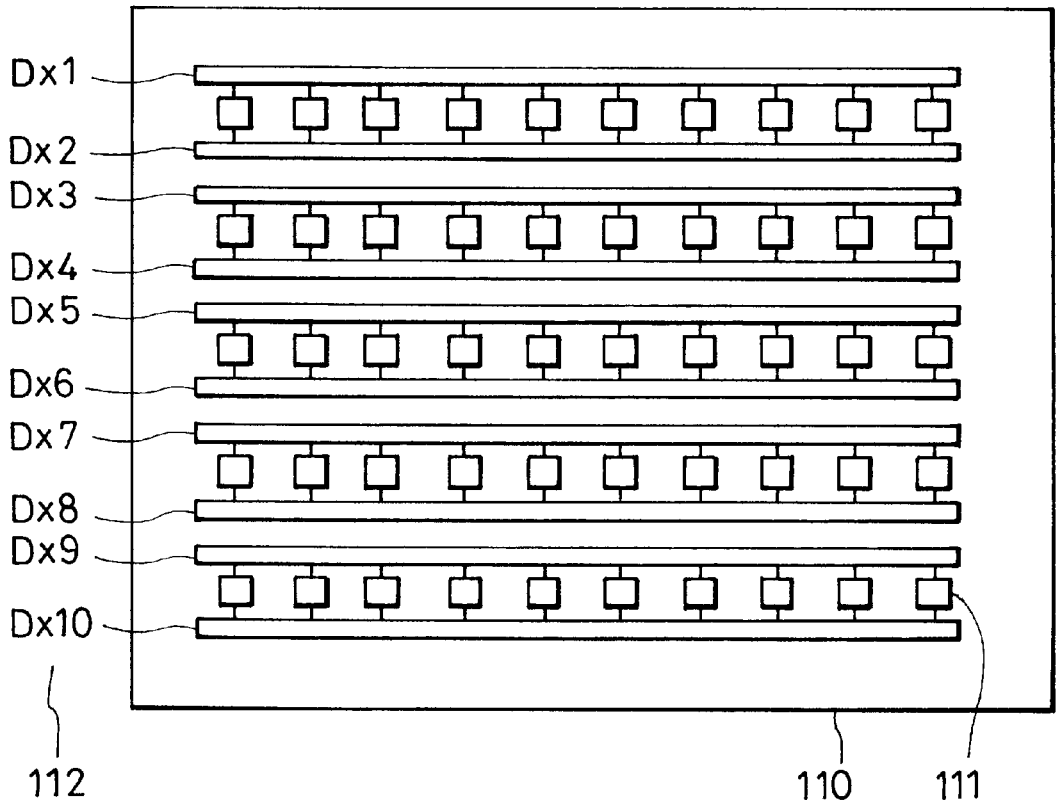
FIG. 11 is a schematic view of a ladder type electron source.

Next, a ladder type electron source and image forming apparatus will be described with reference to FIGS. 11 and 12. FIG. 11 is a schematic view of a ladder type electron source. The electron source includes an electron source substrate 110, and electron emission devices 111 arranged on the electron source substrate 110, and common lead lines Dx1 to Dx10 connected to the electron emission devices 111. The electron emission devices 111 are arranged in series in the horizontal (X-axis) direction to form a plurality of device lines (five in the drawing). Thus, the electron source comprises a plurality of horizontal device lines. Each device line independently drives by a driving voltage applied to the two common lead lines connected to the device line. In other words, a voltage higher than the threshold voltage for electron emission is applied to lines that permit emission of electron beams, whereas a voltage lower than the threshold voltage is applied to the other lines that do not permit emission of electron beams. Among the common lead lines Dx2 to Dx9 disposed between the device lines, for example, lead lines Dx2 and Dx3 may be replaced with a common lead line.

Figure 12:
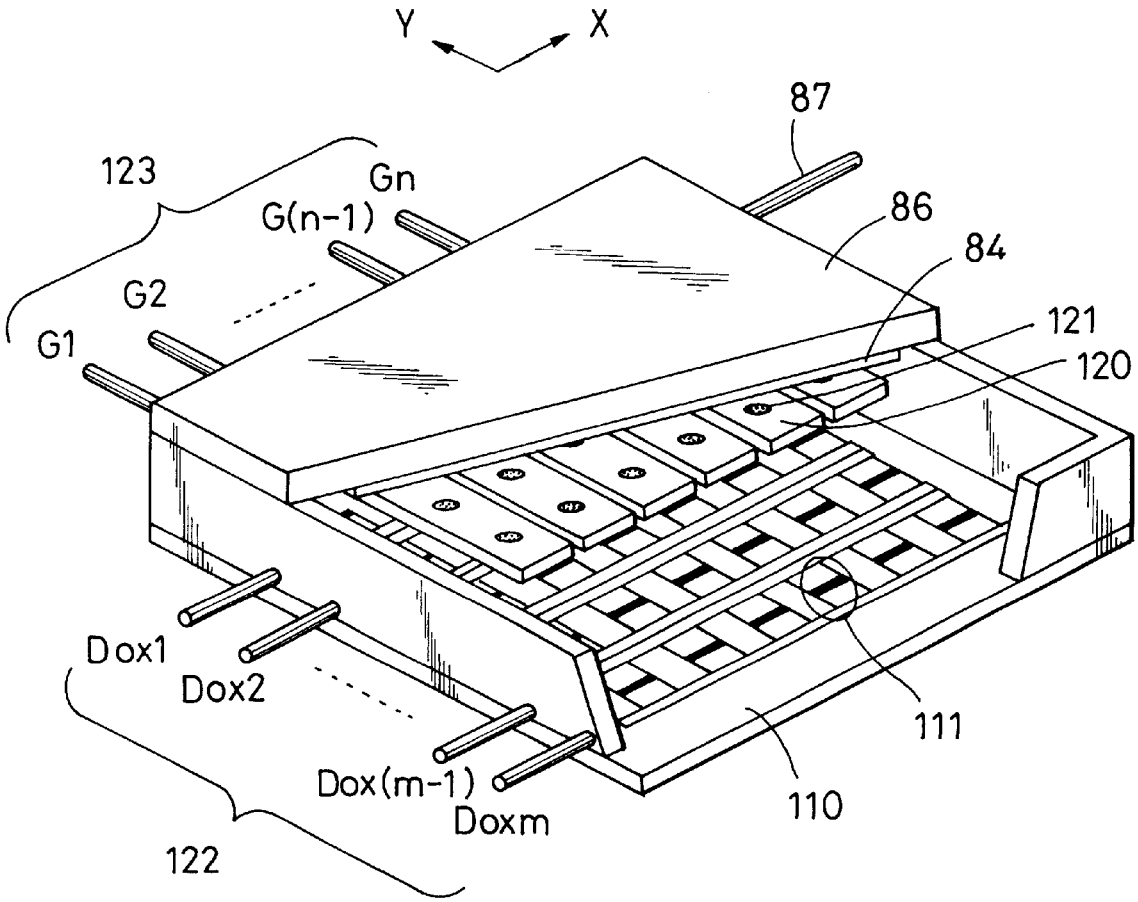
FIG. 12 is a schematic view of a panel of an image forming apparatus provided with the ladder type electron source.

FIG. 12 is a schematic view of a panel of an image forming apparatus provided with the ladder type electron source, wherein numeral 120 represents grid electrodes, and numeral 121 represents openings which allow transit of electrons. Parts having the same functions as in FIG. 11 are referred to with the same numerals, and a detailed description thereof with reference to drawings has been omitted. The image forming apparatus shown in FIGS. 12 is fundamentally different from the simple matrix image forming apparatus shown in FIG. 8 in that the former has the grid electrodes 120 between the electron source substrate 110 and the face plate 86. The grid electrodes 120 modulates the electron beams emitted from the surface conductive type electron emission devices. Each grid electrode 120 has circular openings 121. The number of the openings 121 is equal to the number of devices. Electron beams pass through the openings 121 toward stripe electrodes provided perpendicular to the ladder type device lines. The shape and position of the grids are not limited to those shown in FIG. 12. For example, the grids may comprise a mesh having many openings or passages. The grids may be arranged at the peripheries of, or in the vicinity of, the surface conductive type electron emission devices.

The outside terminals are connected to a control circuit (not shown in the drawing). In the image forming apparatus in this embodiment, each device line is driven or scanned in series while a series of modulation signals corresponding to one line of image are synchronously applied to the corresponding grid electrode rows. The fluorescent substance is irradiated with the emitted electron beams to cause fluorescence with various luminances corresponding to one line of image.

The image forming apparatus in accordance with the present invention can be applied to display devices for television broadcasting, television conferencing, and computer systems, and to optical printers provided with photosensitive drums.

EXAMPLES

The present invention will now be described in more detail with reference to the following examples. It is our intention that the invention not be limited by any of these examples, and it is believed obvious that modification and variation of our invention is possible in light of the examples.

Example 1

Example 1 in accordance with the present invention will be described with reference to FIGS. 1A, 1B, 3A to 3C, 8A, 8B, and 13A to 13C. Referential Example 1 according to a method other than that of the present invention will also be described, in which a step for sealing after forming an electron emitting section is not provided. Example 1 is characterized in that a frit compound is not applied onto a rear plate (electron source substrate).

With reference to FIGS. 1A, 1B, and 8A, an electron source substrate 81 provided with a matrix of surface conductive type electron emission devices 74 was produced in the following steps 1 to 5.

Step 1) With reference to FIGS. 1A and 1B, a blue plate glass substrate 1 was cleaned.

Step 2) A plurality of electrode groups each including a pair of electrodes 2 and 3 were formed on the glass substrate 1 by a thick-film screen printing process to form a matrix of the electrode groups. The used thick-film paste is an MOD paste (DU-2120 made by Noritake Co., Ltd.) and contains gold as a metal component. The substrate was dried at 100° C. for 20 minutes, and then fired at 580° C. for approximately 8 minutes. The thickness of the electrodes after firing was 0.3 $\mu$m. The distance between the electrodes 2 and 3 was 50 $\mu$m.

Step 3) With reference now to FIG. 8A, Y-axis lead lines 73 were formed on the substrate 81 (corresponding to the substrate 1 in FIGS. 1A and 1B) by a thick-film screen printing process using a paste NP-4028A made by Noritake Co., Ltd., containing silver as a metal component. The substrate 81 was fired under the same conditions as in the step 2. Each Y-axis lead line 73 was connected to the electrodes 2 (FIGS. 1A and 1B) in the corresponding row.

Step 4) An insulating interlayer (not shown in the drawing) was formed between the Y-axis lead lines 73 and X-axis lead lines 72 that will be formed in the subsequent step 5 by a thick-film screen printing process using a paste containing a mixture of PbO, as a primary component, and a glass binder under the same firing conditions as in the step 2. The insulating interlayer secures electrical insulation between the lead line 73 and the lead line 72.

Step 5) The X-axis lead lines 72 were formed by the same procedure as in the Y-axis lead lines 73. Each X-axis lead line 72 was connected to the electrodes 3 (FIGS. 1A and 1B) in the corresponding line.

Next, with reference to FIGS. 1A and 1B, a conductive thin film 4 was formed over each pair of electrodes 2 and 3 in the following step 6.

Step 6) An organic palladium compound (CCP4230 made by Okuno Chemical Industries Co., Ltd.) was sprayed onto the substrate through a mask having 300-$\mu$m square patterns. The substrate was fired at 350° C. for 1 hour to form a PdO conductive thin film 4 over the electrodes 2 and 3. The conductive thin film 4 had a thickness of 15 nm, was composed of fine particles having a particle size of approximately 7 nm, and had a sheet resistance of $5\times10^4$ Ω/sheet.

An electron emitting section was formed in the conductive thin film 4 in the following steps 7 to 9.

Step 7) With reference to FIG. 8A, the substrate was placed into a glass container, and the X-axis lead lines Dx1 to Dxm and the Y-axis lead lines Dy1 to Dym were connected to external terminals (not shown in the drawing). The glass container was thoroughly evacuated using a vacuum pump to a high degree of vacuum. A predetermined sequence of triangular pulse voltages was applied to each pair of electrodes through the external terminals so that the conductive thin film 4 disposed over the electrodes was subjected to forming treatment. The pulse voltages were gradually increased as shown in FIG. 4B. An electron emitting section 5 was thereby formed in the center of the conductive thin film 4.

Step 8) The substrate provided with the electron emitting sections 5 was subjected to activation treatment. Acetone was introduced into the vacuum glass container until the pressure became approximately $1\times10^{-5}$ Torr while each device was driven for one hour. Carbon was deposited on each device and thus the device current If and the emission current Ie increased.

Step 9) The glass chamber was evacuated to a vacuum pressure of approximately $1\times10^{-6}$ Torr and then heated to 150° C. for one hour to stabilize the electron emitting sections 5 without further deposition of carbon.

The electron source substrate 81 as shown in FIG. 8A was thereby formed. The glass container was released to atmospheric pressure to remove the substrate.

Next, a face plate 86 in FIG. 8A was produced as follows. Black stripes composed of graphite as a main component were formed on a glass substrate 83. Color fluorescent substances were applied onto spaces between the stripes by a slurry coating process to form a fluorescent film. The inner surface of the fluorescent film was subjected to smoothing (generally called filming), and then aluminum was deposited on the smoothed surface by a vacuum deposition process to form a metal back layer 86. In some cases, a transparent electrode (not shown in the drawings) may be provided on the outer surface to enhance the conductivity of the fluorescent film; however, it was not formed in this example since the metal back layer 85 had sufficiently high conductivity.

Figure 13A:
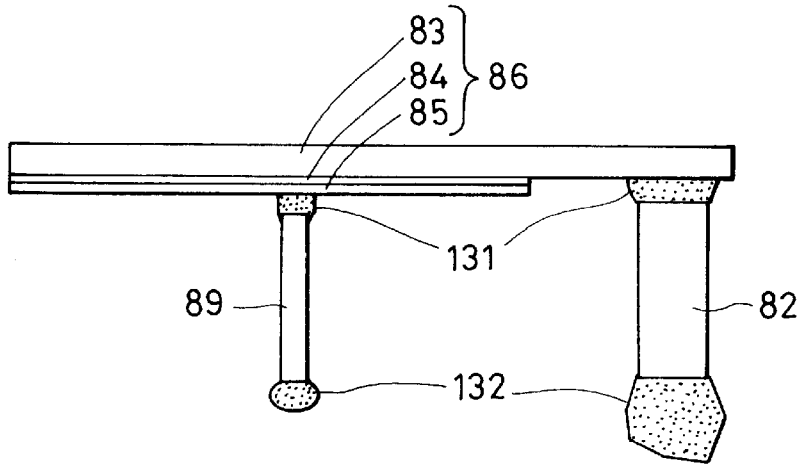
FIGS. 13A to 13C are cross-sectional views of production steps in the present invention.
Figure 13B:
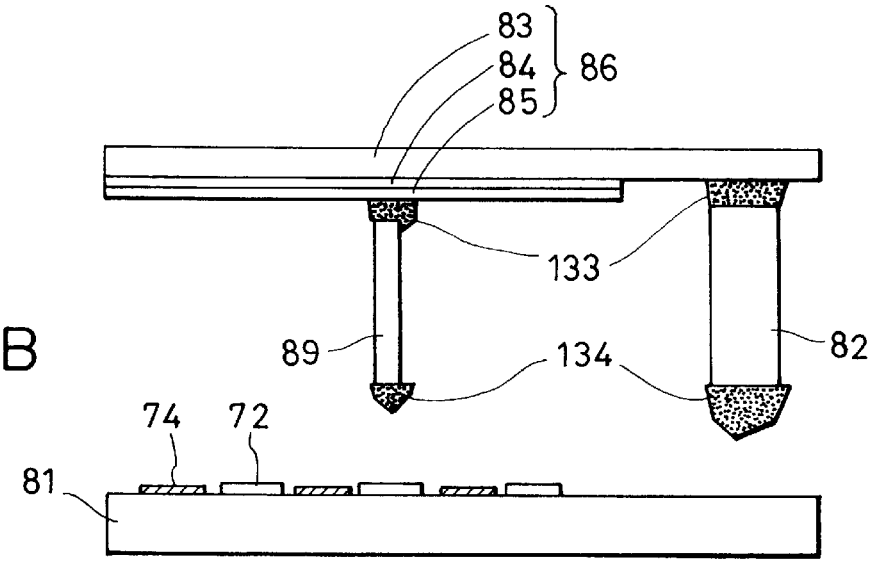
Figure 13C:
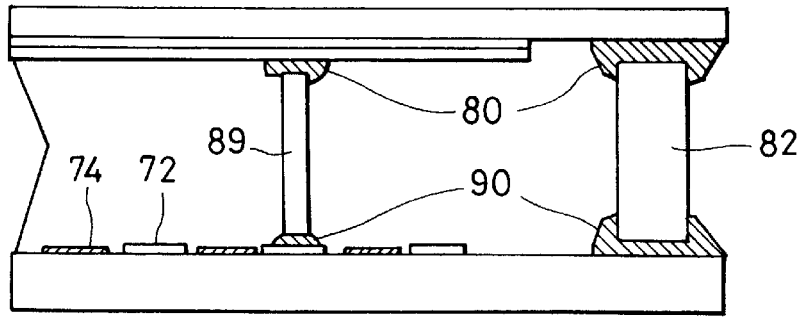

With reference now to FIGS. 13A to 13C, an image forming apparatus was produced using the electron source substrate 81 and the face plate 86 provided with the fluorescent film 84 and the metal back layer 85 as follows. The electron source substrate 81 was used as a rear plate. The height of the frame 82 was 4 mm.

A frit compound 131 was applied at positions for placing a spacer 89 and a frame 82 on the face plate 86. Crystalline frit glass powder LS-7105 made by Nippon Sheet Glass Co., Ltd. was used as the frit glass component of the frit compound. The vehicle component of the frit compound was composed of polyisobutyl methacrylate as a binder and terpineol as a solvent. The vehicle components mixed with the frit glass powder so as to impart a desired viscosity to the glass powder paste. This combination of the frit glass, binder, and solvent composed the frit compound 131. The frit compound 131 was applied using a discharging unit provided with a dispenser so that the nearest distance between the frame 82 and the electron emission devices 74 on the electron source substrate 81 was 30 nm and the distance between the spacer 89 and the electron emission device 74 was 1 mm.

After aligning of the spacer 89 and the frame 82, they were connected to the face plate 86. The frit compound 132 was applied onto the other ends of the spacer 89 and the frame 82 as shown in FIG. 13A. Calcination was performed at 390° C. for 10 minutes in an atmosphere to remove the vehicle by pyrolysis and to soften the frit glass so that the frit glass 133 and 134 had a slight flowability as shown in FIG. 13B.

The face plate 86 with the spacer 89 and the frame 82, and the rear plate 81 were exactly aligned so that each color fluorescent substance and the corresponding electron emission device lie at the same position. The frit glass was fired at a temperature higher than the calcination temperature, that is, 450° C. for 20 minutes in the atmosphere to securely seal the connections, as shown in FIG. 13C.

The resulting package comprising the face plate 86, the flame 82, and the rear plate 81 was evacuated by a vacuum chamber through an exhaust pipe (not shown in the drawing). The exhaust pipe was sealed and then the package was subjected to getter treatment to maintain a high vacuum.

With reference to FIGS. 8A, scanning signals and modulation signals from a signal generator (not shown in the drawing) were applied to the resulting image forming apparatus through external terminals Dx1 to Dxm, Dy1 to Dym, respectively, and the emitted electron beams were accelerated by a high voltage of 4 kV applied to the metal back layer through the high-voltage terminal Hv. The accelerated electron beams collided with the fluorescent film 84 to form a fluorescent image.

This image forming apparatus has a small depth because the thickness of the display panel provided with an electron beam source of surface conductive type electron emission devices can be readily achieved. In addition, the display panel with a large area and high luminance has a large view angle. Accordingly, the image forming apparatus can display images with the feeling of being at a live performance and high visibility.

Figure 23A:
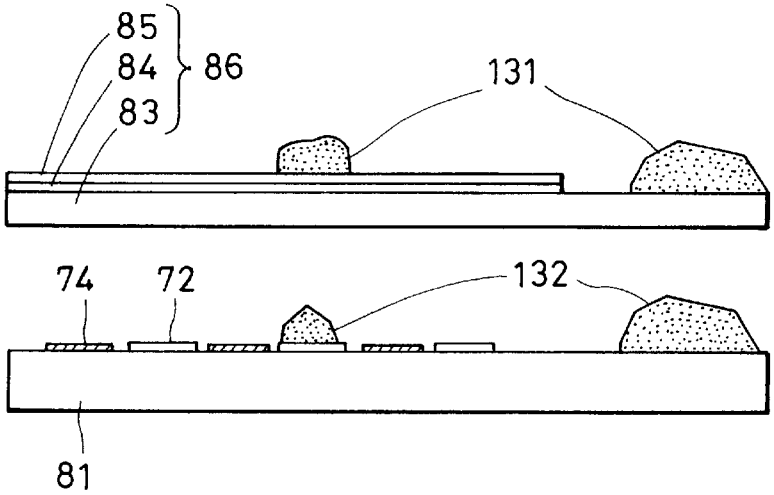
FIGS. 23A to 23C are cross-sectional views of production steps in Referential Example 1.
Figure 23B:
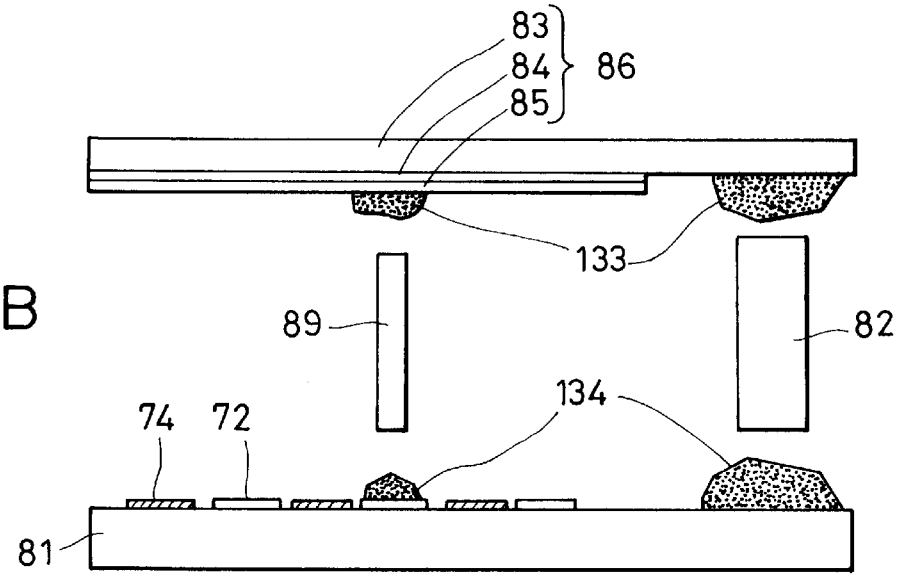
Figure 23C:
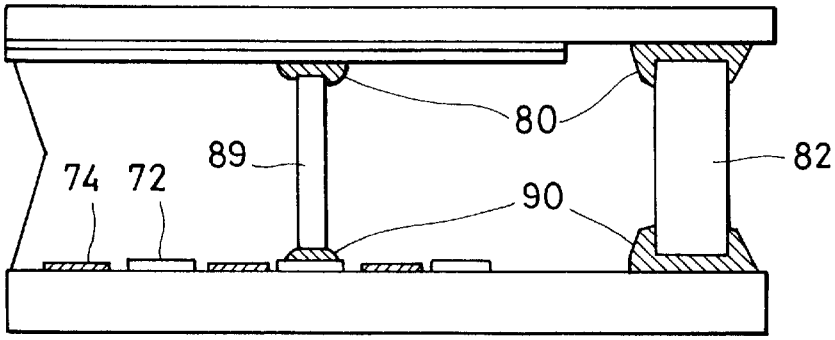

As Referential Example 1, an image forming apparatus as shown in FIGS. 23A to 23C was formed as follows, wherein the production of the rear plate and face plate, the composition and heating temperature of the frit glass were the same as in Example 1.

The frit compound, 131 and 132, was applied onto both the rear plate 81 and the face plate 86, as shown in FIG. 23A, and then subjected to calcination, as shown in FIG. 23B. The frame 82 and the spacer 89 were placed at the positions 131 and 132 of the frit compound (FIG. 23B), and then the face plate 81, the spacer 89, the frame 82, and the rear plate 81 were fixed as in Example 1 (FIG. 23C).

In the calcination steps of both Example 1 and Referential Example 1, the vehicle in the frit compound is decomposed to evolve gas. The temperature of gas evolution and the type and volume of the evolved gas depend on the composition and amount of the vehicle and the atmosphere. In Example 1 and Referential Example 1, gas due to evaporation and/or pyrolysis of terpineol as the solvent was evolved at a temperature up to 200° C., and gas due to pyrolysis of polyisobutyl methacrylate as the binder was evolved at 200 to 380° C. The main components of the gas were reductive gases, such as $H_2$, and $COH_4$, and other gases, such as $H_2O$ and $CO_2$.

Figure 14:
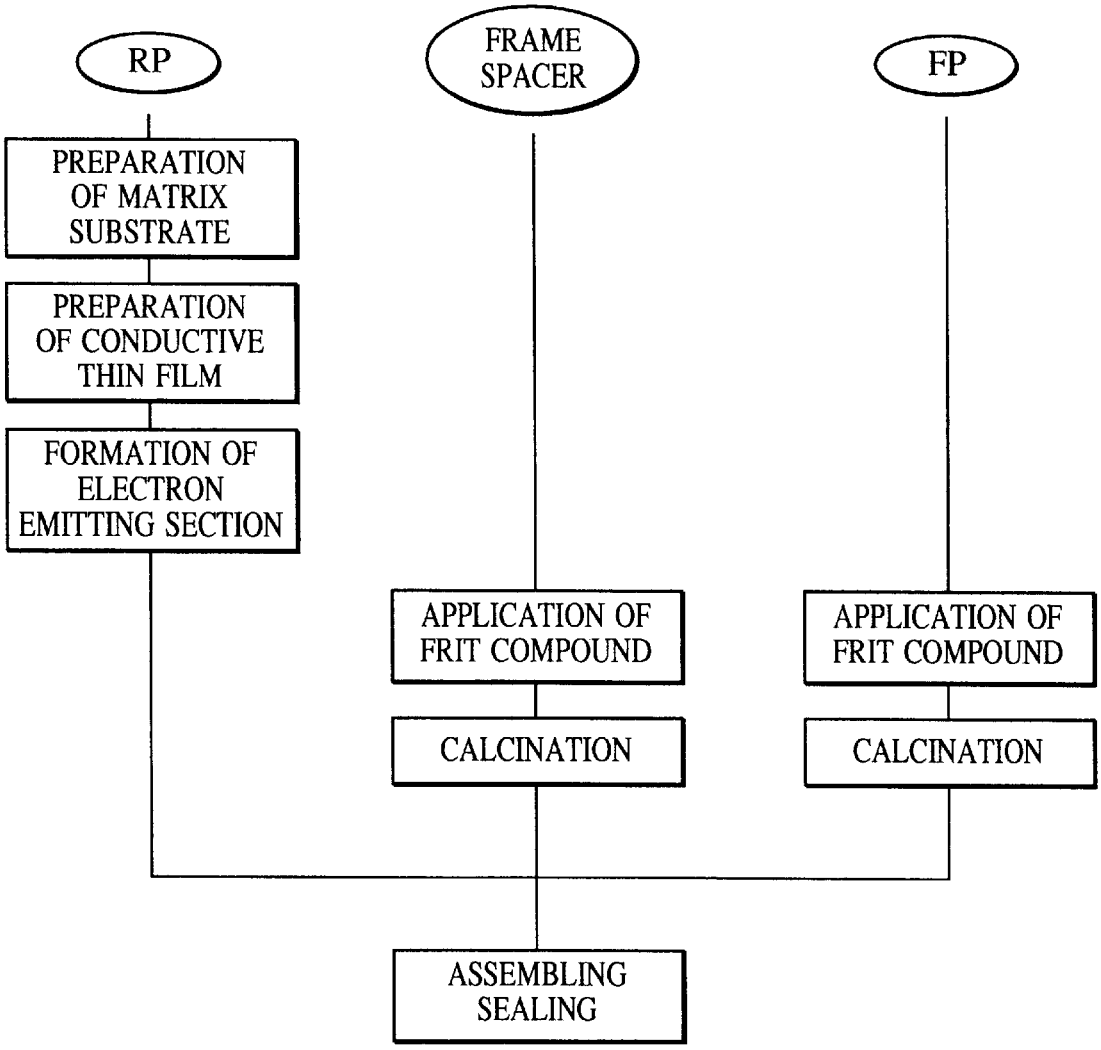
FIG. 14 is a flow chart of an assembly process in Example 1.
Figure 24:
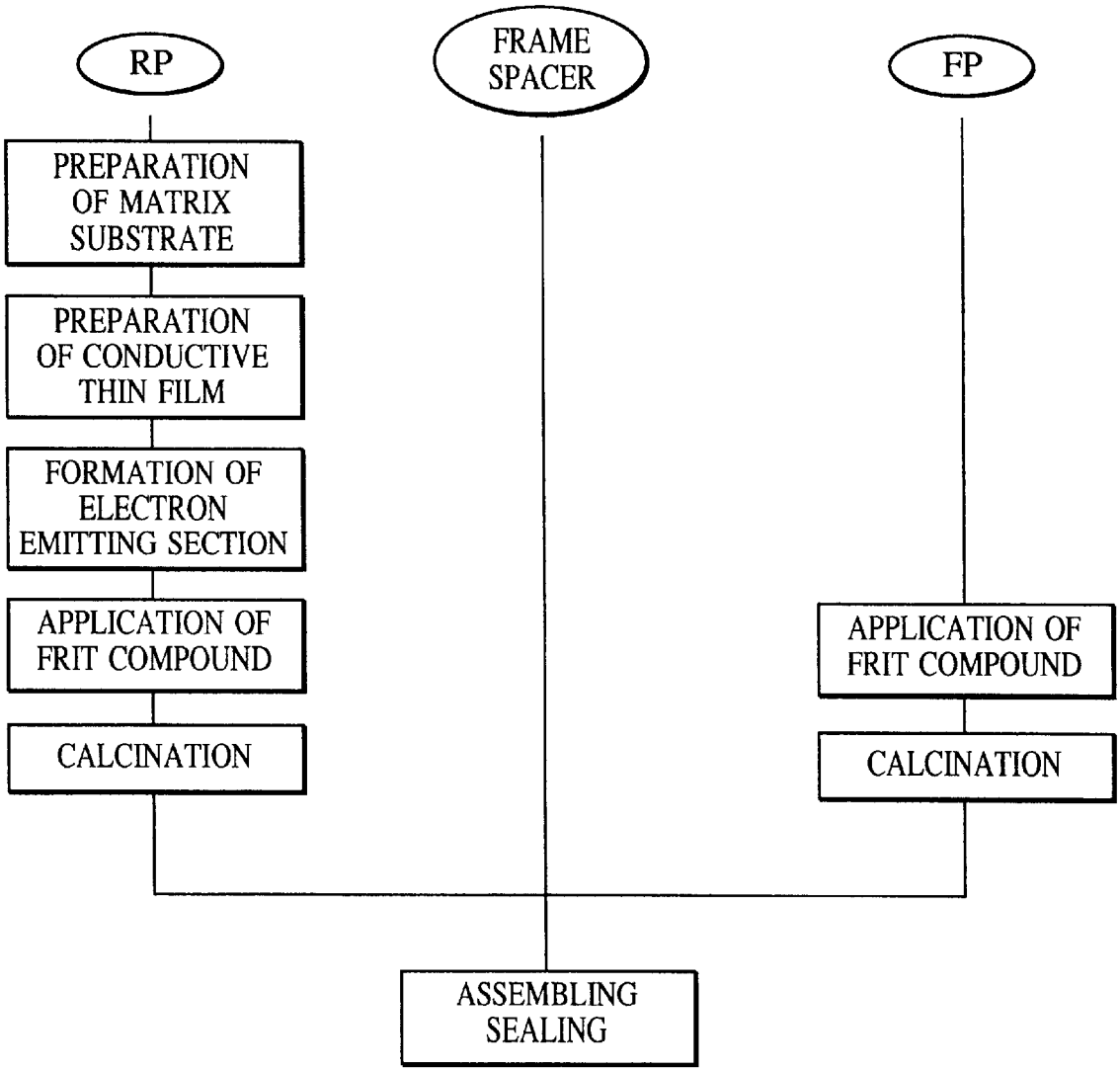
FIG. 24 is a flow chart of an assembly process in Referential Example 1.

FIG. 14 is a flow chart of the production steps in Example 1, and FIG. 24 is a flow chart of the production steps in Referential Example 1.

In Example 1, the frit compound is applied to the face plate, the frame and the spacer, followed by calcination; hence the rear plate provided with the electron source is not subjected to application and calcination of the frit compound. Thus, the elements of the electron emission device do not come into contact with the reductive gas formed during the calcination. In contrast, in Referential Example 1, the frit compound is applied to the rear and face plates, hence the elements of the electron emission device inevitably comes into contact with the reductive gas formed during the calcination at a high temperature. The electron emission devices in the image forming apparatus produced in Example 1 have superior characteristics to the devices in Referential Example 1, as follows. The device current If per device at a driving voltage of 18 v is approximately 1 mA for Example 1 or 0.15 mA for Referential Example 1, the emission current Ie per device is approximately 0.8 $\mu$A for Example 1 or 0.005 $\mu$A for Referential Example 1.

Example 2

In Example 2, a conductive thin film 4 was first formed, a sealing step was performed, and then an electron emitting section 5 was formed in the conductive thin film 4. Thus, the frit compound was applied onto the rear plate as in Example 1. The frit compound used was a mixture of crystalline glass powder, amorphous glass powder, and nitrocellulose as a binder.

Figure 15:
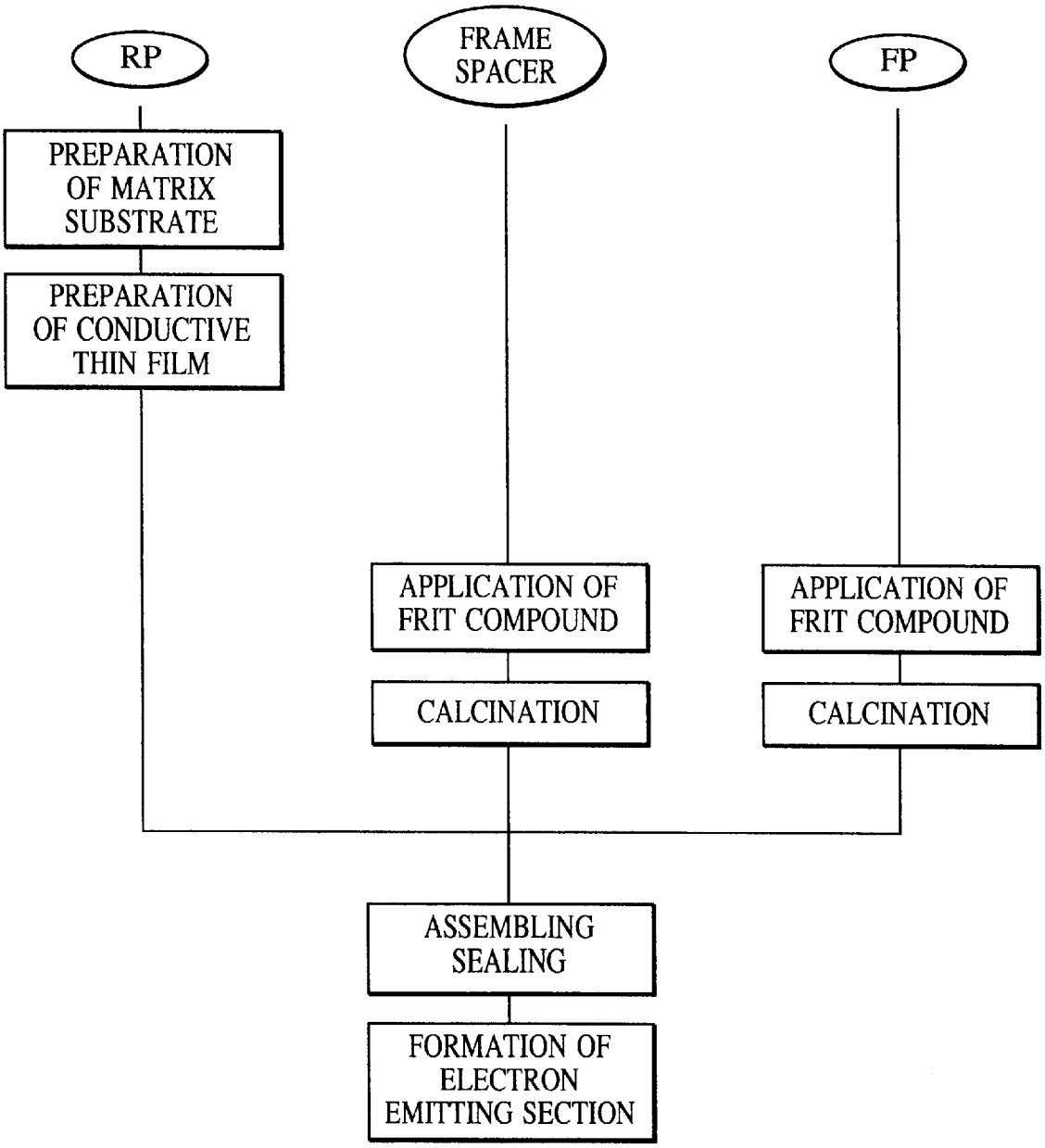
FIG. 15 is a flow chart of an assembly process in Example 2.

FIG. 15 is a flow chart of production steps in Example 2. An electron source substrate provided with conductive thin films 4 in a matrix, each being formed over a pair of electrodes, was produced by steps 1 to 6 as in Example 1. However, no electron emitting section 5 was, formed in the conductive thin film 4 in this stage.

An image forming apparatus was assembled using the electron source substrate without an electron emitting section 5 as a rear plate 81 and the face plate 86. The frit compound 131 was applied at positions for placing the spacer 89 and the frame 82 on the face plate 86. The frit glass was composite frit glass powder LS-3081 made by Nippon Plate Glass Co., Ltd. To form the frit compound, the frit glass powder was mixed with a nitrocellulose binder and a terpineol solvent to achieve the desired viscosity. The frit compound was applied using a discharging unit with a dispenser.

The spacer 89 and the frame 82 were aligned and then connected to the face plate 86. The frit compound was applied onto the other ends of the spacer 89 and the frame 82, and then these were subjected to calcination at a temperature of 380° C. for 10 minutes in the atmosphere. The face plate 86 and the rear plate 81 were exactly aligned, and then the frit compound was fired at a temperature higher than the calcination temperature, that is, 410° C. for 10 minutes in the atmosphere to seal the connection of the frit compound.

An electron emitting section 5 was formed in the conductive thin film 4 as follows. A package comprising the face plate 86, the frame 82, and the rear plate 81 was thoroughly evacuated by a vacuum pump through an exhaust pipe (not shown in the drawing), and then a voltage was applied to a pair of electrodes of each device through external terminals Dxo1 to Doxm and Dyo1 to Dyon so that the conductive thin film 4 disposed over the electrodes was subjected to the forming treatment as in Example 1. The electron emitting section 5 was thereby formed in the conductive thin film 4.

Acetone was introduced into the package so that the pressure became approximately $1\times10^{-5}$ and then each device was driven for one hour to deposit carbon on the device. The activation treatment resulted in increases in the device current If and the emission current.

The package was evacuated to a high degree of vacuum of approximately $1\times10^{-6}$ Torr and heated to 150° C. for one hour to stabilize the device. The electron emission device 74 was thereby produced. The exhaust pipe (not shown in the drawing) was sealed and then the package was subjected to getter treatment to maintain a high vacuum.

Scanning signals and modulation signals from a signal generator (not shown in the drawing) were applied to the resulting image forming apparatus through external terminals Dx1 to Dxm, Dy1 to Dym, respectively, and the emitted electron beams were accelerated by a high voltage of 4 kV applied to the metal back layer or a transparent electrode (not shown in the drawing) through the high-voltage terminal Hv. The accelerated electron beams collided with the fluorescent film 84 to form a fluorescent image.

In Example 2, the frit compound is applied to the face plate 86, the frame 82 and the spacer 89, followed by calcination; hence the rear plate 81 provided with the electron source is not subjected to application and calcination of the frit compound. Thus, the elements of the electron emission device do not come into contact with the reductive gas formed during the calcination. The electron emission devices in the image forming apparatus produced in Example 1 have superior characteristics, such as a high emission current Ie, regardless of the type and the frit compound, and the composition of the vehicle. The device, therefore, can display significantly uniform, stable images.

Figure 25:
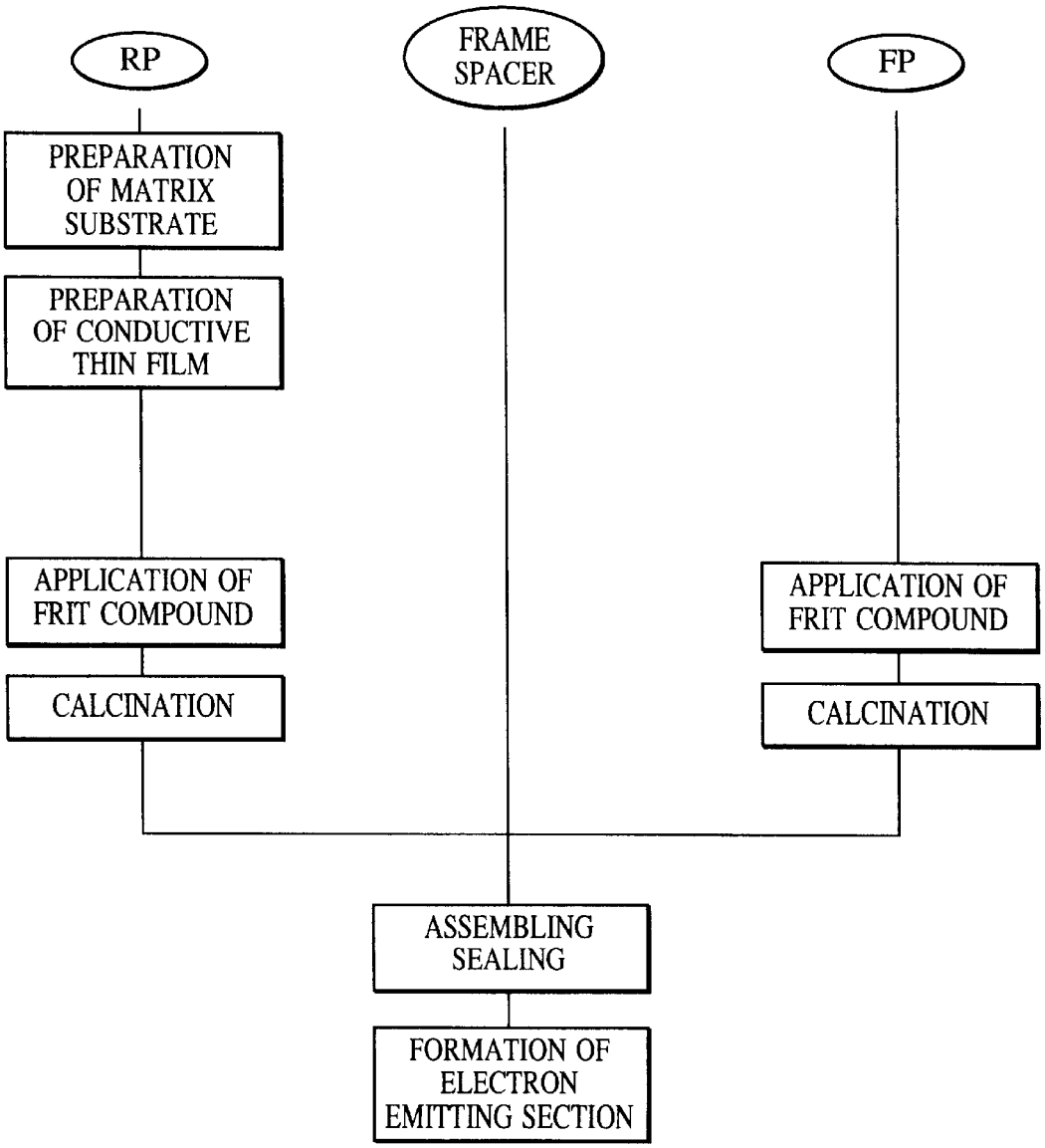
FIG. 25 is a flow chart of an assembly process in Referential Example 1.

FIG. 25 is a flow chart of production steps in Referential Example 2, in which the frit compound is also applied to the rear plate and subjected to calcination as in Referential Example 1, after the formation of the conductive thin film 4 in the electron emission device as in Example 2. The composition of the frit compound and the heating temperature are the same as those in Example 2. In Referential Example 2, the frit compound is applied to the rear and face plates, hence the elements of the electron emission device inevitably comes into contact with the reductive gas formed during the calcination at a high temperature. As a result, the image forming apparatus in Example 2 has a higher emission current Ie than that in Referential Example 1.

In Examples 1 and 2, the frit compound may be applied to these two ends of the frame and the spacer, without application onto the face plate.

Example 3

Figure 16:
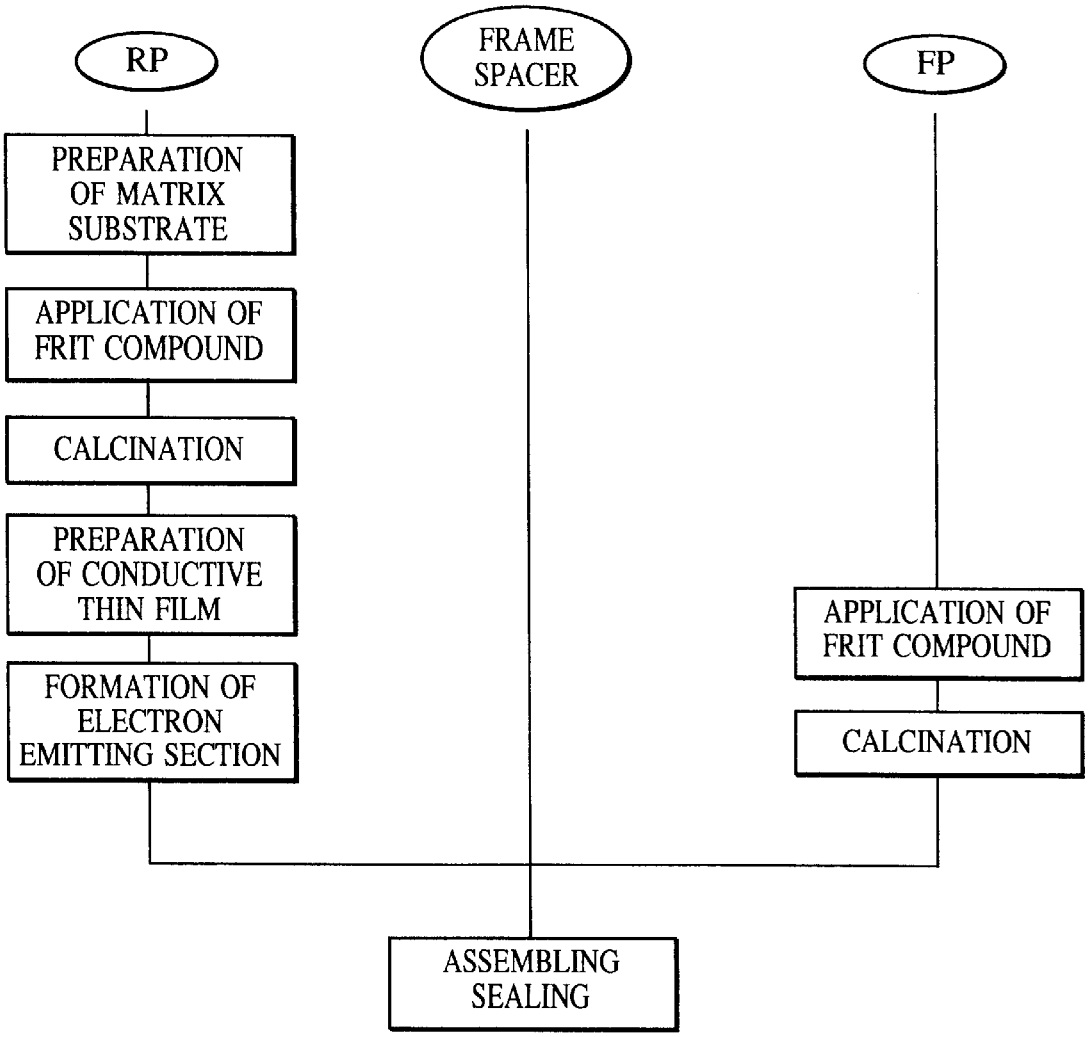
FIG. 16 is a flow chart of an assembly process in Example 3.

FIG. 16 is a flow chart of production steps in Example 3. The production steps were modified from those in Examples 1 and 2. That is, the process in Example 3 includes a step for applying the frit compound on the rear plate. The composition of the frit compound, the conditions for application, calcination, and sealing were the same as those in Example 1.

An electron source substrate provided with a matrix of paired electrodes connected to X- and Y-axis lead lines 72 and 73 was produced as in steps 1 to 5, and used as a rear plate 81. The frit compound 132 was applied at predetermined positions to provide the spacer 89 and the frame 82 on the rear plate 81. Also, the frit compound 132 was applied at predetermined positions to provide the spacer 89 and the frame 82 on the face plate 86. Both the rear plate 81 and the face plate were subjected to calcination under the conditions as in Example 1. A conductive thin film 4 was formed over each pair of electrodes according to step 6 in Example 1. The rear plate 81, the face plate 86, the frame 82, and the spacer 89 were aligned and then bonded to each other by sealing.

An electron emitting section 5 was formed in each conductive thin film 4 as in Example 2, was subjected to activation treatment. The package comprising the face plate, the frame, and the rear plate was thoroughly evacuated and sealed to form an image forming apparatus. In Example 3, the order of the sealing and the formation of the electron emitting section is changeable.

Also, in Example 4, the conductive thin film 3 and the electron emitting section 5 do not come into contact with the reductive gas. As a result, the image forming apparatus has electron emission devices with superior electron discharging characteristics, such as a large emission current Ie.

Example 4

Figure 17:
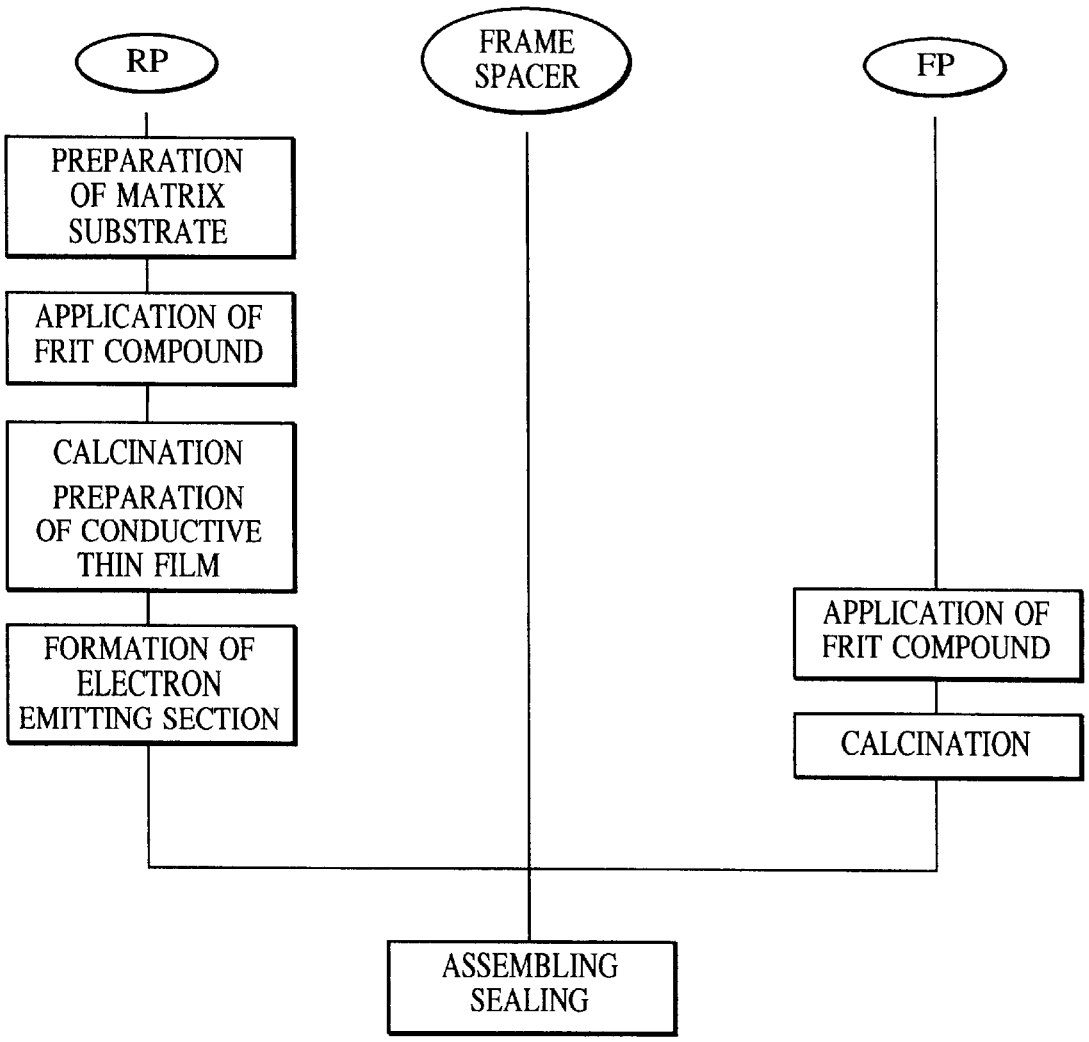
FIG. 17 is a flow chart of an assembly process in Example 4.

FIG. 17 is a flow chart of a production process of Example 4. The production steps were modified from those in Examples 1 and 2. That is, the process in Example 4 includes a step for applying the frit compound on the rear plate. The composition of the frit compound, the conditions for application, calcination, and sealing were the same as those in Example 1. In Example 4, palladium acetate was used instead of the organic palladium compound in Example 1. An electron source substrate provided with a matrix of electron emission devices was produced by the steps 1 to 6 in Example 1.

The firing of palladium acetate and calcination of the frit compound were simultaneously performed in Example 4. Palladium acetate was applied over each pair of electrodes, and then the frit compound was applied onto predetermined positions of the electron source substrate. The electron source substrate was heated to form a conductive thin film 4 by pyrolysis of palladium acetate and to achieve calcination of the frit compound. The frit compound was also applied to predetermined positions on the face plate and then subjected to calcination. The electron source substrate, the face plate, the frame, and the spacer were exactly aligned and then bonded to each other by sealing. An electron emission section was formed on the conductive thin film 4 and activated as in Example 2. The package comprising the electron source substrate, the face plate and the frame was thoroughly evacuated and then sealed. The electron emitting section may be formed after the bonding of the package members.

Electron emission devices of the image forming apparatus in Example 4 had superior electron discharging characteristics, such as a large emission current Ie.

Example 5

Figure 18A:
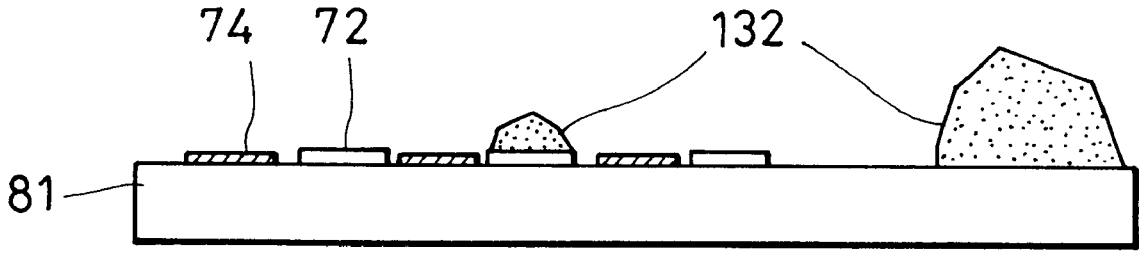
FIGS. 18A and 18B are cross-sectional views of production steps in Example 5.
Figure 18B:
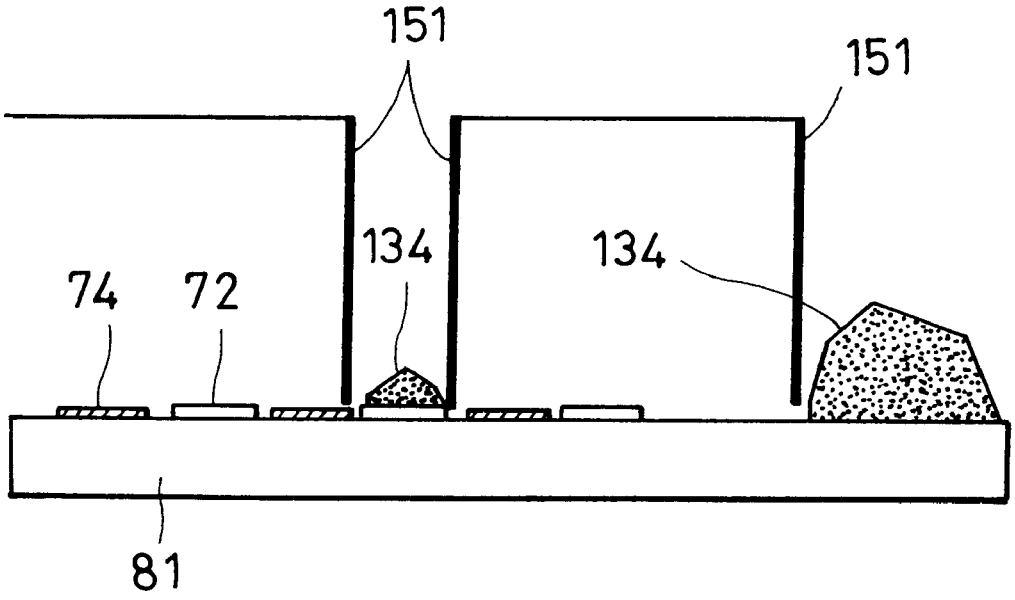

FIGS. 18A and 18B are schematic cross-sectional views of production steps of an image forming apparatus in Example 5. In Example 5, the frit compound was applied onto the rear plate, after conductive thin films were formed, or after electron emitting sections were formed. Partition walls were provided between the frit compound and the constituents of the electron emission device so that the constituents were not exposed to reductive gas from the frit compound. The composition of the frit compound and the conditions of coating and firing were the same as those in Example 1.

An electron source substrate as a rear plate 81 was formed according to the steps 1 to 6 in Example 1. A frit compound 132 was applied to positions for providing a spacer and a frame on the rear plate 81, as shown in FIG. 18A. The frit compound was also applied to positions for providing the spacer and the frame on the face plate, although not shown in the drawing.

Partition walls were provided between the frit compound 132 and the constituents of the electron emission device 74 to isolate the constituents from the reductive gas from the frit compound, as shown in FIG. 18B. The rear and face plates were subjected to calcination as in Example 1. After removing the partition walls, the rear plate, the face plate, a frame, and a spacer were aligned and then heated to a temperature higher than the calcination temperature for bonding these units. Next, an image forming apparatus was produced as in Example 2.

Since the constituents of the electron emission device do not come into contact with the reductive gas from the frit compound, the image forming apparatus has superior electron discharging characteristics.

Example 6

Figure 19A:
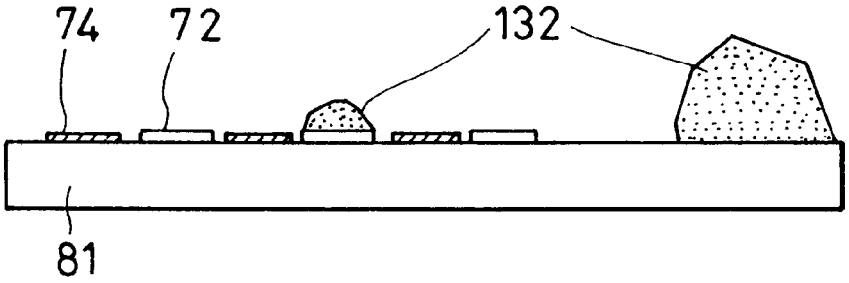
FIGS. 19A and 19B are cross-sectional views of production steps in Example 6.
Figure 19B:
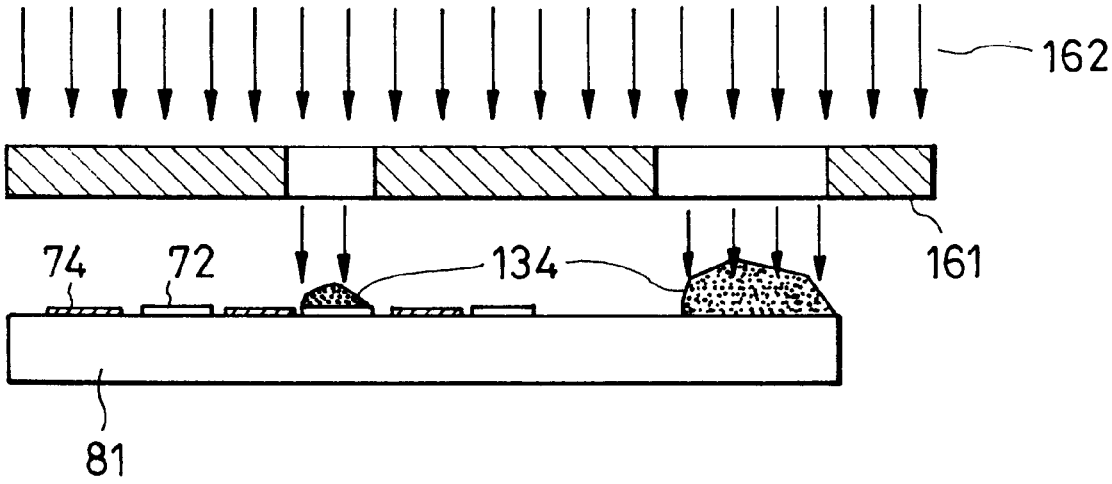

FIGS. 19A and 19B are schematic cross-sectional views of production steps of an image forming apparatus in Example 6. In Example 6, the frit compound applied onto the rear plate was subjected to calcination by localized heating. The composition of the frit compound and the conditions of coating were the same as those in Example 1.

An electron source substrate as a rear plate 81 was formed according to steps 1 to 6 in Example 1. A frit compound 132 was applied to positions for providing a spacer and a frame on the rear plate 81, as shown in FIG. 19A. The frit compound also was applied to positions for providing the spacer and the frame on the face plate, although not shown in the drawing. The face plate was subjected to calcination as In Example 1, whereas the rear plate 81 was subjected to calcination by localized heating treatment. For the localized heating treatment, an optical mask having openings corresponding to the applied positions of the frit compound 132 was arranged on the rear plate 81, and then the rear plate 81 was irradiated with infrared rays 162 through the optical mask 161, as shown in FIG. 19B. The optical mask 161 was removed. The rear plate, the face plate, a frame, a spacer were aligned and bonded to each other by sealing at a temperature higher than the calcination temperature (not shown in the drawing). Next, an image forming apparatus was formed as in Example 2.

In Example 6, the constituents of the electron emission device are not so significantly heated. Thus, the reductive gas from the frit compound does not substantially affect the conductive thin film, although the conductive thin film 4 is exposed to the reductive gas. As a result, the image forming apparatus has superior electron emission characteristics, such as a large emission current Ie.

Example 7

Figure 20A:
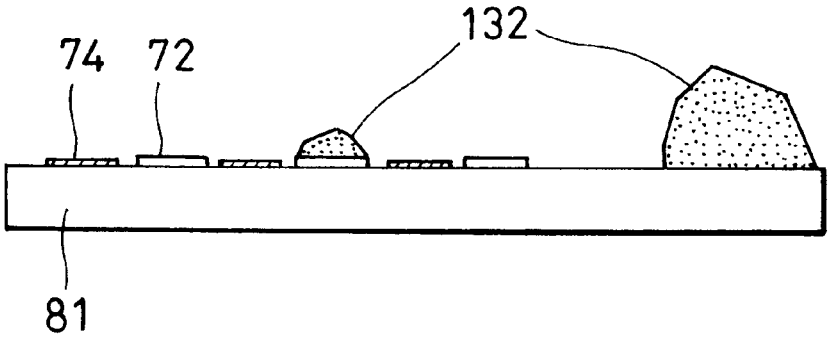
FIGS. 20A and 20B are cross-sectional views of production steps in Example 7.
Figure 20B:
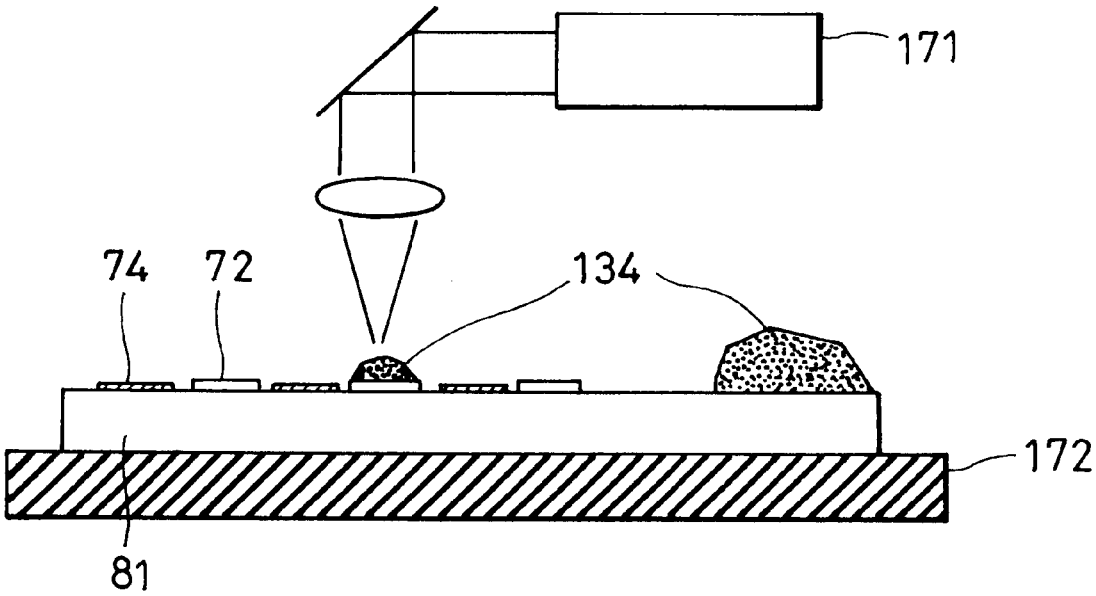

FIGS. 20A and 20B are schematic cross-sectional views of production steps of an image forming apparatus in Example 7. In Example 7, the frit compound applied onto the rear plate was subjected to calcination by a localized heating process which is different from that in Example 6.

The composition of the frit compound and the conditions of coating were the same as those in Example 1.

An electron source substrate as a rear plate 81 was formed according to steps 1 to 6 in Example 1. A frit compound 132 was applied to positions for providing a spacer and a frame on the rear plate 81, as shown in FIG. 20A. The frit compound was also applied to positions for providing the spacer and the frame on the face plate, although not shown in the drawing. The face plate was subjected to calcination as in Example 1, whereas the rear plate 81 was subjected to calcination by localized heating treatment. For the localized heating treatment, the rear plate 81 was fixed onto an XY stage 172 and the applied positions of the frit compound 132 were sequentially irradiated with laser light beams 171, as shown in FIG. 20. The rear plate, the face plate, a frame, a spacer were aligned and bonded to each other by sealing at a temperature higher than the calcination temperature (not shown in the drawing). Next, an image forming apparatus was formed as in Example 2.

In Example 7, further localized heating of the applied positions of the frit compound is achieved compared to Example 6, the other constituents can be maintained at approximately room temperature during the heating treatment. Furthermore, the volume of gas evolved in a period of time can be further reduced as a result of the sequential heating of the applied positions.

Example 8

Figure 21A:
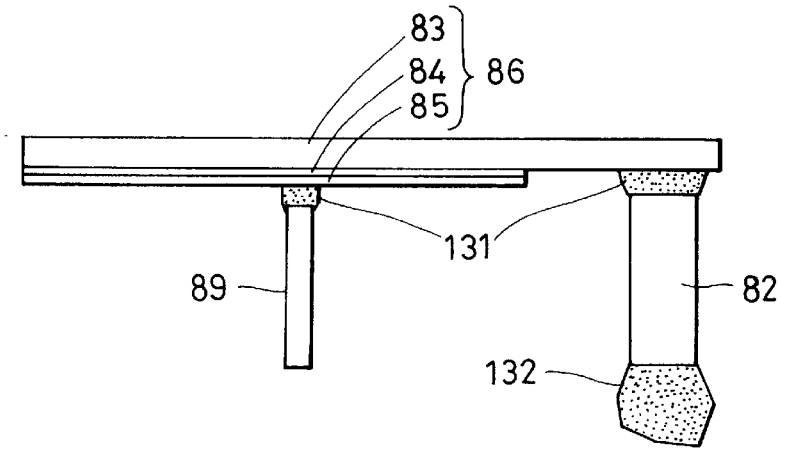
FIGS. 21A to 21C are cross-sectional views of production steps in Example 8.
Figure 21B:
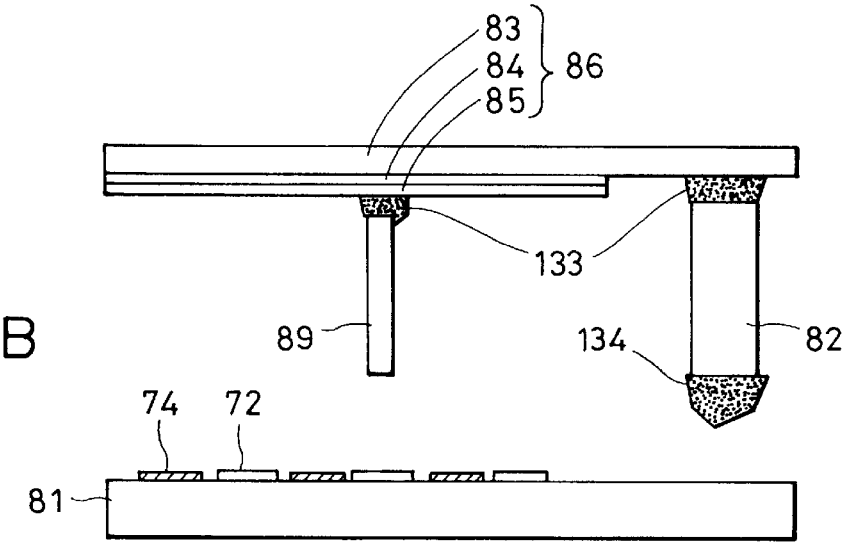
Figure 21C:
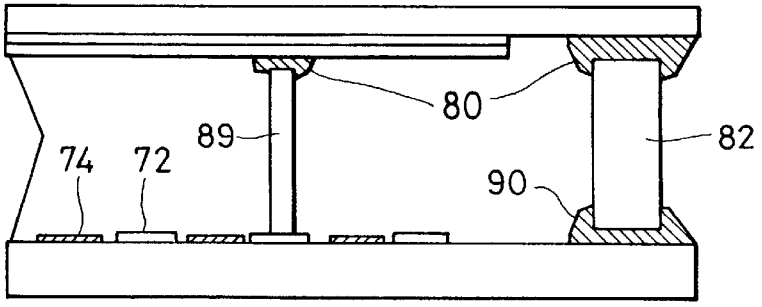

FIGS. 21A to 21C are cross-sectional views of Example 8, in which a frit compound is not applied to the rear plate, as in Example 1.

An electron source substrate was formed according to steps 1 to 6 in Example 1. The electron source substrate comprises a matrix df devices which are connected to X-axis lines 72 and Y-axis line (not shown in FIGS. 21A to 21C). Each device has a pair of electrodes and a conductive thin film provided over these electrodes. A first frit compound 131 was applied to a position for providing a frame 82 on a face plate 86 and a second frit compound 131A was applied to a position for providing a spacer 89. A first frit compound 132 was also applied to the other end, which will come into contact with a rear plate 81 later, of the frame 82, as shown in FIG. 21A. The first frit compound was composed of a powdered frit glass LS-3081 made by Nippon Electric Glass Co., Ltd., polyisobutyl methacrylate as a binder, a terpineol as a solvent. The frit compound had a binder content of 10%. The second frit compound was composed of an amorphous frit glass powder LS-0200 made by Nippon Electric Glass Co., Ltd., isobutyl methacrylate as a binder, and terpineol as a solvent. This frit compound also had a binder content of 10%. The first and second frit compounds were applied through discharging units with dispensers.

These frit compounds were subjected to calcination at 380° C. for 10 minutes under atmospheric pressure as shown in FIG. 21B. Next, the face plate 86, the rear plate 81, the spacer 89, and the frame 82 were exactly aligned and jointed to each other to form a package by sealing at 420° C. for 10 minutes under atmospheric pressure, as shown in FIG. 21C. An image forming apparatus was formed using the package as in Example 2.

In Example 8, the constituents of the electron emission devices do not come into contact with gas evolved during the calcination. Thus, the image forming apparatus has excellent electron emitting characteristics such as a large emission current Ie.

Example 9

Figure 22A:
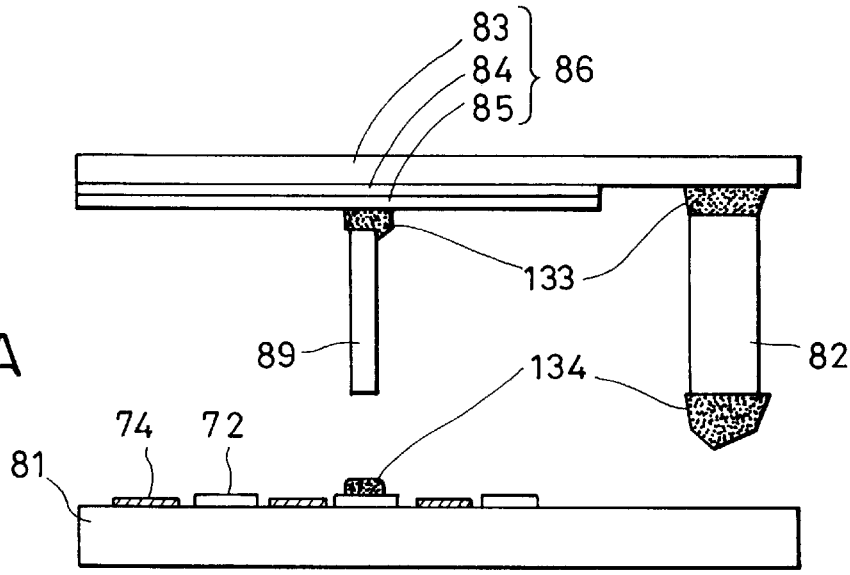
FIGS. 22A and 22B are cross-sectional views of production steps in Example 9.
Figure 22B:
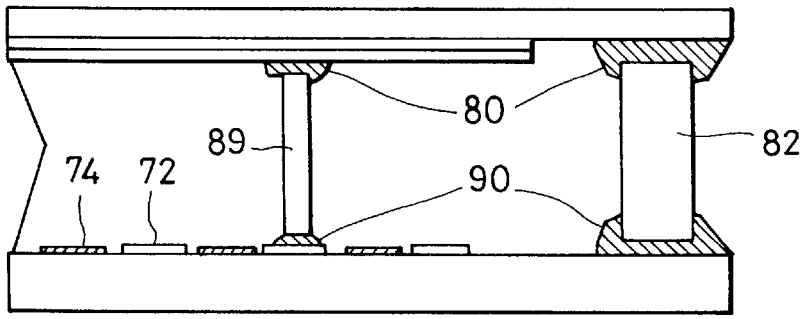

FIGS. 22A and 22B are cross-sectional views of production steps of an image forming apparatus in Example 9, in which a frit compound is applied to a position for providing a spacer, but not applied to a position for providing a frame, on a rear plate.

An electron source substrate was formed according to steps 1 to 6 in Example 1. The electron source substrate comprises a matrix of devices which are connected to X-axis lines 72 and Y-axis line (not shown in FIGS. 22A and 22B). Each device has a pair of electrodes and a conductive thin film provided over these electrodes. A first frit compound 133 was applied to a position for providing a spacer 89 on a face plate 86 by a discharging unit with a dispenser. The first frit compound was composed of a powdered amorphous frit glass LS-0200 made by Nippon Electric Glass Co., Ltd., polyisobutyl methacrylate as a binder, a terpineol as a solvent. The frit compound had a binder content of 3%. The face plate was subjected to calcination at 380° C. for 10 minutes under atmospheric pressure.

A second frit compound 133 was applied to a position for providing a spacer 82 on a face plate 86. The frit compound was composed of a powdered frit glass LS-3081 made by Nippon Electric Glass Co., Ltd., polyisobutyl methacrylate as a binder, a terpineol as a solvent. This frit compound had a binder content of 10%. The second frit compound was applied through a discharging unit with a dispenser.

Next, the first frit compound was applied to a position 134 for providing the spacer 89 on a rear plate 81. The face plate 86 and the rear plate 81 were subjected to calcination at 390° C. for 10 minutes under atmospheric pressure, as shown in FIG. 22A.

The face plate 86, the rear plate 81, the spacer 89, and the frame 82 were exactly aligned and jointed to each other to form a package by sealing at 420° C. for 10 minutes under atmospheric pressure, as shown in FIG. 22B. An image forming apparatus was formed using the package as in Example 2.

In Example 9, a frit compound is not applied to a position for providing the frame on the rear plate, hence a the volume of gas coming in contact with the constituents in the electron emission devices can be remarkably reduced during the calcination of the frit compounds. The image forming apparatus has superior electron emitting characteristics such as a large discharging current Ie. Any combination of the configurations shown in Examples 5 to 7 also can be effective in the present invention. For example, partition walls shown in Example 5 may be used instead of the frame 82. The position for providing the spacer 89 may be locally heated. Although the spacer is provided along the X-axis lead line 72, other spacer configurations are allowable in the present invention. The type of the binder is not limited. A solvent, which adversely affects the constituents of the electron emission devices in conventional processes, may be used in the present invention. While the present invention has been described with reference to what are presently considered to be the preferred embodiments, it will be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of making an image forming apparatus comprising an assembly of a first unit provided with an image-forming element and a second unit provided with electron emission devices, said method comprising the steps of:

providing a bonding agent at a bonding section of the second unit;

heating the bonding agent; and then forming electron emitting members of the electron emission devices prior to assembling the first unit and the second unit.

2. A method of making an image forming apparatus comprising an assembly of a first unit provided with an image-forming element and a second unit provided with electron emission devices, said method comprising the steps of:

providing a bonding agent at a bonding section of the second unit and providing a partition;

disposing the partition between the bonding agent and the electron emission devices; and then heating the bonding agent.

3. A method according to claim 2, further comprising the steps of:

removing the partition; and then assembling the image forming apparatus.

4. A method of making an image forming apparatus comprising an assembly of a first unit provided with an image-forming element and a second unit provided with electron emission devices, said method comprising the steps of:

providing a bonding agent at a bonding section of the second unit; and then locally heating the bonding agent by irradiation through an optical mask.

5. A method of making an image forming apparatus comprising an assembly of a first unit provided with an image-forming element and a second unit provided with electron emission devices, said method comprising the steps of:

providing a bonding agent at a bonding section of the second unit; and then locally heating the bonding agent with a laser prior to assembling the first unit and the second unit.

6. A method of making an image forming apparatus comprising an assembly of a first unit provided with an image-forming element and a second unit provided with electron emission devices, said method comprising the steps of:

providing a bonding agent at a bonding section of the first unit;

heating the bonding agent remote from the second unit;

forming an electron emitting member for each of the electron emission devices; and then bonding the first and the second unit.

7. A method of making an image forming apparatus comprising an assembly of a first unit provided with an image-forming element and a second unit provided with electron emission devices, said method comprising the sequential steps of:

providing a bonding agent at a bonding section of the second unit;

heating the bonding agent;

forming electron emitting members of the electron emission devices; and assembling the first unit and the second unit.

* * * * *

UNITED STATES PATENT AND TRADEMARK OFFICE

CERTIFICATE OF CORRECTION

PATENT NO. : 6,309,272 B1
DATED : October 30, 2001
INVENTOR(S) : Michiyo Nishimura It is certified that error appears in the above-identified patent and that said Letters Patent is hereby corrected as shown below:

Column 1,
Line 36, "pk" should be deleted.

Column 2,
Line 53, "a" (first occurrence) should be deleted.

Column 4,
Line 18, "1;" should read -- 1; and --; and
Line 21, "1;" should read -- 1. --.

Column 5,
Line 58, "then" should read -- than --.

Column 21,
Line 18, "4," should read -- 3, --.

Column 23,
Line 32, "df" should read -- of --.

Column 24,
Line 36, "a the" should read -- the --;
Line 42, "Ie. Any" should read -- ie. ¶ Any --; and
Line 52, "invention. While" should read -- invention. ¶ While --.

Signed and Sealed this

Seventh Day of May, 2002

*Attest:*

*Attesting Officer*

JAMES E. ROGAN
*Director of the United States Patent and Trademark Office*